US008238795B2

(12) United States Patent
Kawamura

(10) Patent No.: US 8,238,795 B2
(45) Date of Patent: Aug. 7, 2012

(54) IMAGE FORMING APPARATUS

(75) Inventor: Koji Kawamura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/353,766

(22) Filed: Jan. 19, 2012

(65) Prior Publication Data

US 2012/0114376 A1 May 10, 2012

Related U.S. Application Data

(62) Division of application No. 12/891,159, filed on Sep. 27, 2010, now Pat. No. 8,116,664, which is a division of application No. 11/621,780, filed on Jan. 10, 2007, now Pat. No. 7,826,773.

(30) Foreign Application Priority Data

Jan. 11, 2006 (JP) ..... 2006-004104
Dec. 22, 2006 (JP) ..... 2006-346204

(51) Int. Cl.
*G03G 15/01* (2006.01)

(52) U.S. Cl. ..... 399/228

(58) Field of Classification Search ..... 399/223, 399/228, 298, 299
See application file for complete search history.

(56) References Cited

U.S. PATENT DOCUMENTS

| | | | |
|---|---|---|---|
| 6,795,671 | B2 | 9/2004 | Matsuoka |
| 7,376,373 | B2 | 5/2008 | Kim et al. |
| 7,555,242 | B2 | 6/2009 | Zensai |
| 2007/0081831 | A1 | 4/2007 | Yoon |
| 2007/0160386 | A1 | 7/2007 | Kawamura |
| 2007/0177899 | A1 | 8/2007 | Kawamura |

FOREIGN PATENT DOCUMENTS

JP 2003-215876 A 7/2003

*Primary Examiner* — David Gray
*Assistant Examiner* — Ruth Labombard
(74) *Attorney, Agent, or Firm* — Fitzpatrick, Cella, Harper & Scinto

(57) ABSTRACT

An image forming apparatus for forming a color image on a recording material includes mounting means for detachably mounting a plurality of process cartridges each including a photosensitive drum and a developing roller. Movable members are provided that are actable on first and second clutches for switching between an operation state for transmitting the driving force to the developing rollers and a non-operation state not transmitting the driving force thereto. Also provided is a switching member for switching among a first mode for transmitting the driving force to the developing rollers of all of the process cartridges, a second mode for not transmitting the driving force to any one of the developing rollers, and a third mode for transmitting the driving force only to the developing roller of a black process cartridge.

10 Claims, 20 Drawing Sheets

(a)
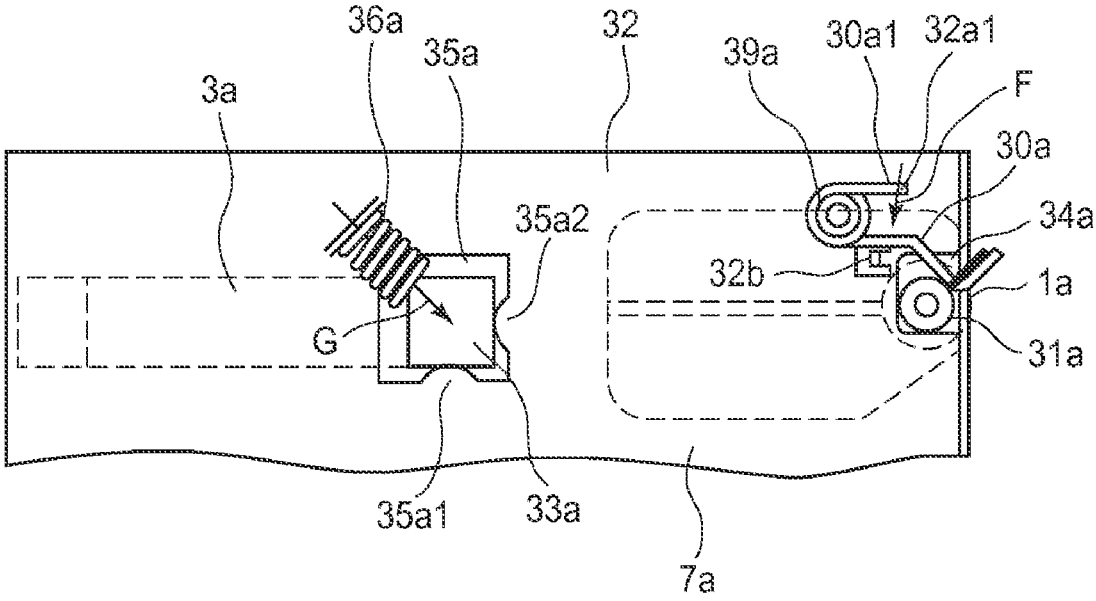
(b)
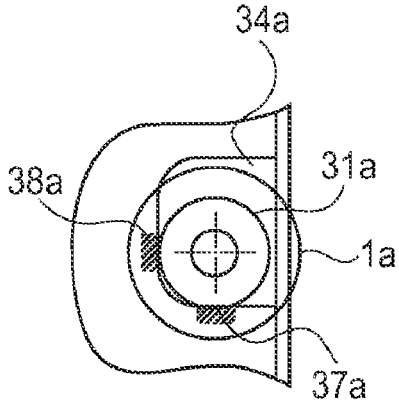
FIG.5

| | | (1) | (2) | (3) | (4) | (1) |
|---|---|---|---|---|---|---|
| MODE | | HOME | MONO-CLR | HOME | FULL-CLR | (HOME) |
| CAM93,94 ANGLE | | 0° | 90° | 180° | 270° | 360° |
| ROD | BK81 | UP | DWN | UP | DWN | UP |
| | CLR80 | UP | UP | UP | DWN | UP |
| CLUTCH | BK92d | OFF | ON | OFF | ON | OFF |
| | CLR92a,92b,92c | ON | OFF | OFF | ON | OFF |
| DEV.RLR-DRUM | BK CTRG7d | SPACE | CONTACT | SPACE | CONTACT | SPACE |
| | CLR CTRGS 7a,7b,7c | SPACE | SPACE | SPACE | CONTACT | SPACE |

FIG.13

| | | (1) | (2) | (3) | (4) | (1) |
|---|---|---|---|---|---|---|
| MODE | | HOME | MONO-CLR | FULL-CLR | MONO-CLR | (HOME) |
| CAM93,94 ANGLE | | 0° | 90° | 180° | 270° | 360° |
| ROD | BK81 | UP | DWN | DWN | DWN | UP |
| | CLR80 | UP | UP | DWN | UP | UP |
| CLUTCH | BK92d | OFF | ON | ON | ON | OFF |
| | CLR92a,92b,92c | ON | OFF | ON | OFF | OFF |
| DEV.RLR-DRUM | BK CTRG7d | SPACE | CONTACT | CONTACT | CONTACT | SPACE |
| | CLR CTRGS 7a,7b,7c | SPACE | SPACE | CONTACT | SPACE | SPACE |

FIG.14

(a)

| | | (1) | (2) | (3) | (1) |
|---|---|---|---|---|---|
| MODE | | HOME | MONO-CLR | FULL-CLR | (HOME) |
| CAM 93,94 ANGLE | | 0° | 90° | 180° | 360° |
| ROD | BK81 | UP | DWN | DWN | UP |
| | CLR80 | UP | UP | DWN | UP |
| CLUTCH | BK92d | OFF | ON | ON | OFF |
| | CLR92a,92b,92c | ON | OFF | ON | OFF |
| DEV.RLR-DRUM | BK CTRG 7d | SPACE | CONTACT | CONTACT | SPACE |
| | CLR CTRGS 7a,7b,7c | SPACE | SPACE | CONTACT | SPACE |

(b)

| | | (1) | (2) | (3) | (1) |
|---|---|---|---|---|---|
| MODE | | HOME | FULL-CLR | MONO-CLR | (HOME) |
| CAM 93,94 ANGLE | | 0° | 180° | 90° | 360° |
| ROD | BK81 | UP | DWN | DWN | UP |
| | CLR80 | UP | DWN | UP | UP |
| CLUTCH | BK92d | OFF | ON | ON | OFF |
| | CLR92a,92b,92c | ON | ON | OFF | OFF |
| DEV.RLR-DRUM | BK CTRG 7d | SPACE | CONTACT | CONTACT | SPACE |
| | CLR CTRGS 7a,7b,7c | SPACE | CONTACT | SPACE | SPACE |

FIG.15

IMAGE FORMING APPARATUS

This application is a divisional of U.S. patent application Ser. No. 12/891,159, filed Sep. 27, 2010, which is a divisional of U.S. application Ser. No. 11/621,780, filed Jan. 10, 2007, now U.S. Pat. No. 7,826,773.

FIELD OF THE INVENTION AND RELATED ART

The present invention relates to an image forming apparatus, such as a copying machine, a printer, a facsimile apparatus, a multifunction apparatus, etc.

As one of the examples of an image forming apparatus which uses an electrophotographic process, a color image forming apparatus of the inline type. A color image forming apparatus of the inline type employs multiple process cartridges, which are juxtaposed in a straight line in the main assembly of the color image forming apparatus. A process cartridge is made up of a photosensitive drum, and one or more processing means which process a photosensitive drum, and a cartridge in which the photosensitive drum and processing means are integrally disposed. A processing means includes a charging means, a developing means, a cleaning means, etc. The charge roller is a means for applying charge bias voltage to a photosensitive drum. The developing means is a means for developing a latent image formed on a photosensitive drum, using developer (toner).

Generally speaking, there are two types of developing methods: contact developing method and noncontact developing method. In the contact developing method, a development roller is placed in contact with a photosensitive drum, whereas in the noncontact developing method, a preset amount of gap is kept between the peripheral surface of a development roller and the peripheral surface of a photosensitive drum.

In the case of the contact developing method, the peripheral surface of a photosensitive drum is shaved as it is rubbed by the peripheral surface of the development roller. Further, the development rollers in the cartridges which are not involved in the ongoing developing operation are also rotated. Therefore, an image forming apparatus in accordance with the prior art sometimes suffered from the problems that the internal components of a cartridge are unnecessary worn; recording paper is soiled by toner; a nonuniform image, the nonuniformity of which is attributable to the deformation of the surface layer of a development roller is formed; etc.

Thus, in order to solve the above described problems, the applicants of the present invention proposed the image forming apparatus stated in Japanese Laid-open Patent Application 2003-215876. In this image forming apparatus, multiple photosensitive drums are always kept in contact with a transfer belt, and are rendered different in the timing with which a developing means is placed in contact with a photosensitive drum. Further, the transmission of driving force to each developing means is synchronized with the timing with which the developing means is placed in contact with the corresponding photosensitive drum. Thus, during an image forming operation, all the photosensitive drums are driven along with the transfer belt, whereas the developing means are selectively driven; only the developing means necessary for the ongoing image forming operation is driven. After the completion of the image forming operation, the developing means is separated from the photosensitive drum, and the transmission of driving force to this developing means is stopped. Then, the driving of all the photosensitive drums and the transfer belt is also stopped.

However, it has long been desired to simplify an image forming apparatus such as the above described one, in the structure for separating the developing means from the corresponding photosensitive drum, and also, to simplify the mechanism for transmitting driving force to the development roller.

SUMMARY OF THE INVENTION

The primary object of the present invention is to provide an image forming apparatus which is substantially simpler in the structure for transmitting driving force to a development roller than an image forming apparatus in accordance with the prior art.

Another object of the present invention is to provide an image forming apparatus which is substantially simpler in the structure for separating a development roller from a photosensitive drum or placing a development roller in contact with a photosensitive drum than an image forming apparatus in accordance with the prior art.

Another object of the present invention is to provide an image forming apparatus which is substantially smaller in the amount by which the life of a process cartridge is unnecessarily reduced than an image forming apparatus in accordance with the prior art.

Another object of the present invention is to provide an image forming apparatus which is superior to an image forming apparatus in accordance with the prior art, in terms of image quality.

According to an aspect of the present invention, there is provided an image forming apparatus for forming a color image on a recording material, comprising i) mounting means for detachably mounting a plurality of process cartridges each including a photosensitive drum and a developing roller for developing an electrostatic latent image formed on said photosensitive drum, said process cartridges including a black process cartridge containing a black color developer and a non-black process cartridge containing a non-black developer; (ii) a driving source; (iii) a first clutch for connecting and disconnecting between said driving source and said developing roller for selective driving force transmission to the black process cartridge; (iv) a second clutch for connecting and disconnecting between said driving source and said developing roller for selective driving force transmission to the non-black process cartridge; (v) a movable first member actable on said first clutch for switching between an operation state for transmitting the driving force to said developing rollers and a non-operation state not transmitting the driving force thereto; (vi) a movable second member, actable on said second clutch, for switching between an operation state for transmitting the driving force to said developing rollers and a non-operation state not transmitting the driving force thereto; (vii) a switching member, movable by the driving force of said driving source and actable on said first member and second member, for switching among a first mode for transmitting the driving force to said developing rollers of all of said process cartridges, a second mode for not transmitting the driving force to any one of said developing rollers, and a third mode for transmitting the driving force only to said developing roller of said black process cartridge.

According to another aspect of the present invention, there is provided an image forming apparatus for forming a color image on a recording material, comprising (i) mounting means for detachably mounting a plurality of process cartridges each including a photosensitive drum, a developing roller for developing an electrostatic latent image formed on said photosensitive drum, a first frame for rotatably supporting said photosensitive drum and a second frame for rotatably supporting said developing roller, said second frame being movable relative to said first frame to contact said developing roller to said photosensitive drum and spacing said developing roller from said photosensitive drum, said process cartridges including a black process cartridge containing a black color developer and a non-black process cartridge containing a non-black developer; (ii) a driving source; (iii) a first clutch for connecting and disconnecting between said driving source and said developing roller for selective driving force transmission to the black process cartridge; (iv) a second clutch for connecting and disconnecting between said driving source and said developing roller for selective driving force transmission to the non-black process cartridge; (v) a first member for switching between an operation state for acting on said first clutch and on said second frame of said black process cartridge to contact said photosensitive drum and said developing roller to each other and transmit the driving force to said developing roller in said black process cartridge, and a non-operation state not transmitting the driving force thereto; (vi) a second member for switching between an operation state for acting on said second clutch and on said second frame of said non-black process cartridge to contact said photosensitive drum and said developing roller to each other and transmit the driving force to said developing roller in said non-black process cartridge, and a non-operation state not transmitting the driving force thereto; (vii) a switching member, movable by the driving force of said driving source and actable on said first member and second member, for switching among a first mode for contacting said developing rollers to said photosensitive drums, respectively and for transmitting the driving force to said developing rollers of all of said process cartridges, a second mode for spacing said developing rollers from said photosensitive drums and for not transmitting the driving force to any one of said developing rollers, and a third mode for contacting said developing roller to said photosensitive drum and for transmitting the driving force only to said developing roller of said black process cartridge.

These and other objects, features, and advantages of the present invention will become more apparent upon consideration of the following description of the preferred embodiments of the present invention, taken in conjunction with the accompanying drawings.

BRIEF DESCRIPTION OF DRAWINGS

FIGS. 5(*a*) and 5(*b*) are a cross-sectional view of the portions of the apparatus main assembly, and a cartridge therein, in the first embodiment, and a side view of the cartridge positioning portion of the apparatus main assembly, and the cartridge therein, respectively, showing how the cartridge is accurately positioned relative to the apparatus main assembly.

FIG. 13 is a table showing the mode switching order in the first example of mode switching sequence.

FIG. 14 is a table showing the mode switching order in the second example of mode switching sequence.

FIG. 15 is a table showing the mode switching order in the third example of mode switching sequence.

DETAILED DESCRIPTION OF THE PREFERRED EMBODIMENTS

[Embodiment 1 ]

Hereinafter, the preferred embodiments of the present invention will be described in detail with reference to the appended drawings.

(Image Forming Apparatus)

Figure 1:
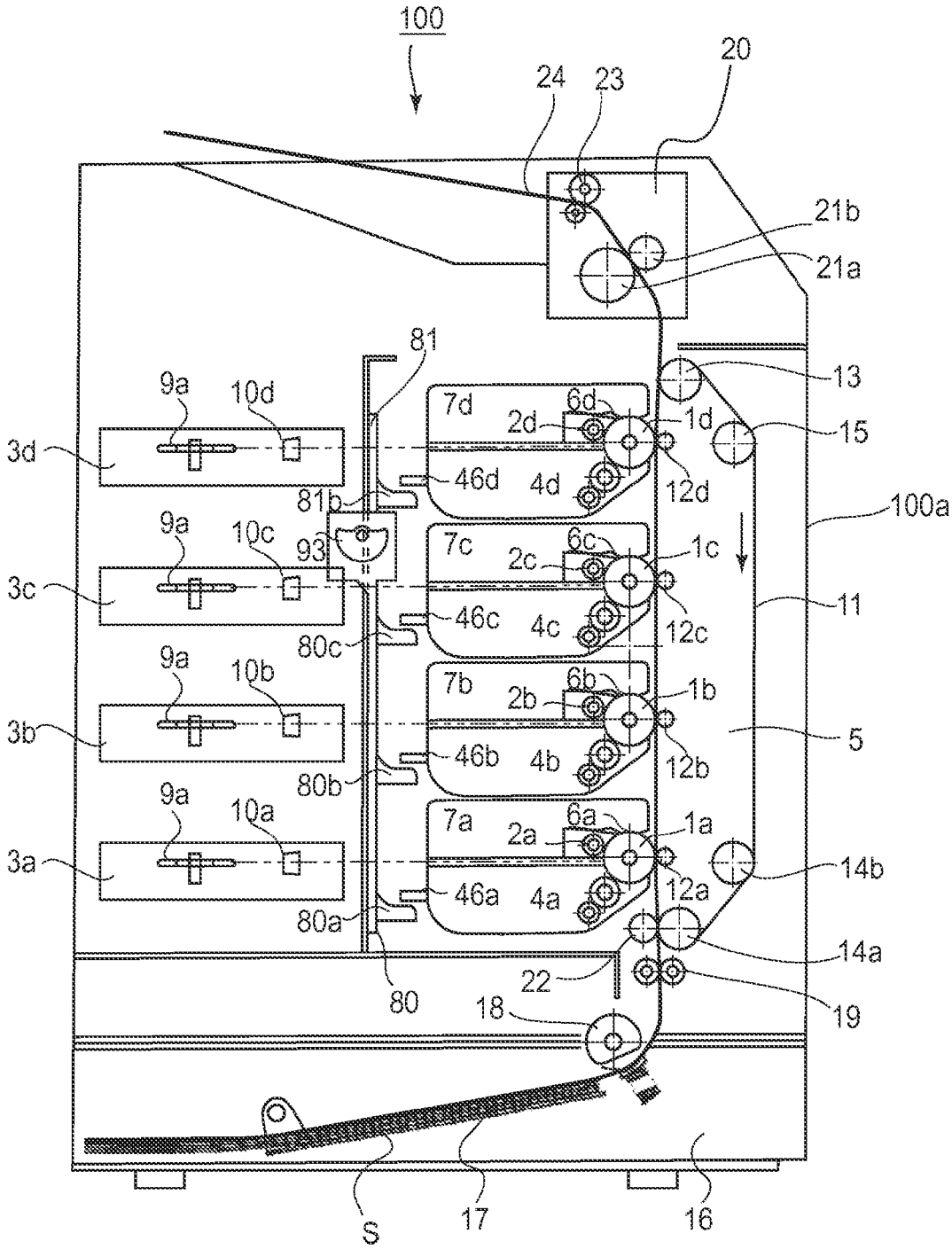
FIG. 1 is a sectional view of the image forming apparatus in the first embodiment of the present invention.

FIG. 1 is a sectional view of a full-color laser beam printer, as an example of an image forming apparatus, showing the overall structure of the main assembly 100 of the full-color laser beam printer (which hereafter will be referred to simply as printer main assembly 100). In this printer main assembly 100, multiple process cartridges 7*a*, 7*b*, 7*c*, and 7*d* (which hereafter may be referred to simply as cartridge), are removably mounted, being juxtaposed in a virtually vertical straight line. The cartridges 7*a*, 7*b*, 7*c*, and 7*d* contain yellow (Y), magenta (M), cyan (C), and black (BK) toners, respectively. Each of the photosensitive drums 1*a*, 1*b*, 1*c*, and 1*d* is made up of a cylinder, and an organic photoconductive layer (OPC) coated on the peripheral surface of the cylinder. Each of the photosensitive drums 1*a*, 1*b*, 1*c*, and 1*d* rotates in the counterclockwise direction by receiving rotational driving force from a motor as a driving force source, through one of the lengthwise ends of its cylinder. The photosensitive drum 1 is processed by the following processing means, which will be described in the order they process the photosensitive drum 1, in terms of the rotational direction of the photosensitive drum 1.

First, the charge rollers 2*a*, 2*b*, 2*c*, and 2*d* uniformly charge the peripheral surfaces of the photosensitive drums 1*a*, 1*b*, 1*c*, and 1*d*, respectively. As examples of charging apparatuses, electrically conductive charge rollers 2*a*, 2*b*, 2*c*, and 2*d* are used. The peripheral surfaces of the photosensitive drums 1*a*, 1*b*, 1*c*, and 1*d* are uniformly charged by applying charge bias to these electrically conductive charge rollers 2*a*, 2*b*, 2*c*, and 2*d* while keeping the electrically conductive charge rollers 2*a*, 2*b*, 2*c*, and 2*d* in contact with the peripheral surfaces of the photosensitive drums 1*a*, 1*b*, 1*c*, and 1*d*, respectively.

Scanner units 3*a*, 3*b*, 3*c*, and 3*d* form an electrostatic latent image on the photosensitive drums 1*a*, 1*b*, 1*c*, and 1*d* by projecting a beam of laser light onto the peripheral surfaces of the photosensitive drums 1*a*, 1*b*, 1*c*, and 1*d*, while modulating the beam of laser light with picture information. The scanner units 3*a*, 3*b*, 3*c*, and 3*d* are disposed at roughly the same levels as the axial lines of the photosensitive drums 1*a*, 1*b*, 1*c*, and 1*d*, respectively. The beams of image formation light, that is, the beams of laser light emitted by laser diodes while being modulated with picture signals, are projected onto polygon mirrors 9*a*, 9*b*, 9*c*, and 9*d* which are being rotated at a high speed by scanner motors (unshown). The beams of image formation light reflected by these polygon mirrors 9*a*, 9*b*, 9*c*, and 9*d* are focused onto the uniformly charged areas of the peripheral surfaces of the photosensitive drums 1*a*, 1*b*, 1*c*, and 1*d*, through focal lenses 10*a*, 10*b*, 10*c*, and 10*d*, selectively exposing numerous points on the uniformly charged areas of the peripheral surfaces of the photosensitive drums 1*a*, 1*b*, 1*c*, and 1*d*, respectively. As a result, electrostatic latent images are effected on the peripheral surfaces of the photosensitive drums 1*a*, 1*b*, 1*c*, and 1*d*, one for one. Referring to FIGS. 5(*a*) and 5(*b*), the length of each scanner unit 3 is greater than the distance between the left and right lateral panels 32, in terms of the lengthwise direction of the scanner unit 3*a*. Thus, the scanner unit 3*a* is attached to the main frame of the apparatus main assembly so that a pair of protrusions 33*a*, with which the scanner unit 3*a* are provided protrude outward beyond the left and right lateral panel 32 through a pair of openings 35*a* which the left and right panel 32 are provided. While the scanner unit 3*a* is in the apparatus main assembly, it is kept pressed in the slantingly downward direction, indicated by an arrow mark G, by roughly 1 kgf of pressure applied by a compression spring 36*a*. Therefore, it is assured that the scanner unit 3*a* is kept pressed upon a pair of scanner unit positioning protrusions 35*a*1 and 35*a*2, remaining thereby accurately positioned. Incidentally, scanner units 3*b*, 3*c*, and 3*d* are also fastened to the lateral panels 32 in the same manner as the scanner unit 3*a*.

Figure 2:
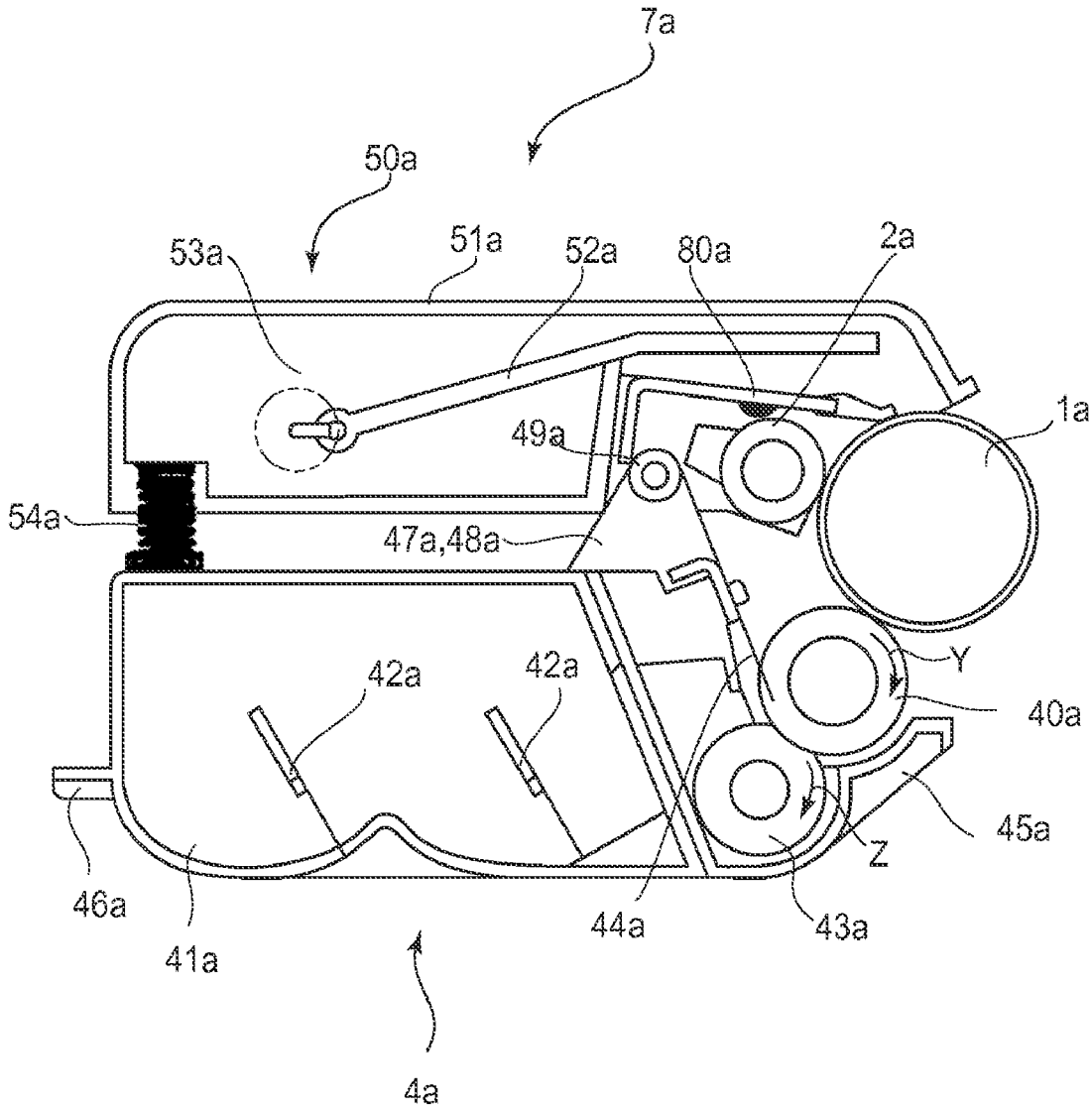
FIG. 2 is a cross-sectional view of the process cartridge in the first embodiment of the present invention, showing the internal structure thereof.

Each of the developing apparatuses 4*a*, 4*b*, 4*c*, and 4*d* develops an electrostatic latent image into a toner (developer) image, that is, an image formed of toner (developer), by adhering toner to the electrostatic latent image. Referring to FIG. 2, the developing apparatuses have toner containers 41*a*, 41*b*, 41*c*, and 41*d*, which store the toners of the abovementioned colors, that is, Y, M, C, and BK colors, respectively. The toner in the toner container 41*a* is sent to a toner supply roller 43*a* by a toner sending mechanism 42*a*. Then, the toner is coated on the peripheral surface of the development roller 40*a*, while being given electric charge, by the developer supply roller 43*a*, and a development blade 44*a* which is kept pressed upon the peripheral surface of the development roller 40*a*. The development roller 40*a* is disposed so that its peripheral surface opposes the peripheral surface of the photosensitive drum 1*a*, on which an electrostatic latent image is formed. The latent image formed on the peripheral surface of the photosensitive drum 1*a* is developed into a toner image by applying development bias to this development roller 40*a*. The functions and operations of each of the development apparatuses 4*b*, 4*c*, and 4*d* are the same as those of the developing apparatus 4*a*.

An electrostatic transferring apparatus 5 is an apparatus which transfers the toner images formed on the peripheral surface of each of the photosensitive drums 1*a*, 1*b*, 1*c*, and 1*d* onto transfer medium (sheet S of recording paper). More specifically, the electrostatic transferring apparatus 5 is provided with an electrostatic transfer belt 11, which is disposed so that it opposes all the photosensitive drums 1 and circularly moves in contact with all the photosensitive drums 1. The electrostatic transfer belt 11 is suspended by being stretched around four rollers, which are a driver roller 13, follower rollers 14*a* and 14*b*, and a tension roller 15. It moves the sheet S to place the sheet S in contact with the photosensitive drums 1, by electrostatically adhering the sheet S to the outwardly facing surface of the left side portion of the electrostatic transfer belt, in terms of the loop the belt 11 forms. In operation, while the sheet S is conveyed from the position of the follower roller 14*a* to the position of the driver roller 13 by the electrostatic transfer belt 11, the toner images on the photosensitive drums 1*a*, 1*b*, 1*c*, and 1*d* are transferred onto the sheet S at the corresponding transfer positions. The electrostatic transferring apparatus 5 is also provided with transfer rollers 12*a*, 12*b*, 12*c*, and 12*d*, which are disposed in contact with the inward side of the electrostatic transfer belt 11, in terms of the loop which the belt 11 forms, opposing the photosensitive drums 1, one for one, at the locations where the photosensitive drums 1 are in contact with the outward side of the belt 11. Through the electrostatic transfer belt 11, positive electric charge is applied to the sheet S from these transfer rollers 12*a*, 12*b*, 12*c*, and 12*d*, generating thereby electric fields. As a result, the toner images, which are negative in polarity, are transferred by the electric fields onto the sheet S while the sheet S is in contact with the photosensitive drums 1.

Cleaning apparatuses 6*a*, 6*b*, 6*c*, and 6*d* are apparatuses for removing the toner remaining on the peripheral surfaces of the photosensitive drums 1*a*, 1*b*, 1*c*, and 1*d* after the transfer of the toner images.

The printer main assembly 100 is also provided with other members and apparatuses than the above described ones. That is, the printer main assembly 100 is provided with a sheet feeding-and-conveying portion, which feeds the sheets S stored in layers in a sheet feeder cassette 17, into the printer main assembly 100, and then, conveys them toward the image forming portion. In an ordinary image forming operation, the sheet feeding-and-conveying roller 18, the cross-section of which is in the form of a half moon, or roughly D-shaped, and a pair of registration rollers 19 rotates, feeding thereby the sheets S from the sheet feeder cassette 17 into the apparatus main assembly while separating them one by one. As the leading edge of each sheet S comes into contact with the interface between the pair of registration rollers 19, the sheet S is temporarily held by the pair of registration rollers 19, while being made to curve so that the center portion of the sheet S, in terms of the direction in which the sheet S is conveyed, separates from the transfer belt 11. Then, the sheet S is released by the pair of registration rollers 19 toward the electrostatic transfer belt 11 with such timing that the writing start line of the sheet S arrives at the interface between the photosensitive drum 1 and transfer belt 11 at the same time as the image formation start line on the peripheral surface of the photosensitive drum 1. The printer main assembly 100 is also provided with a fixing portion 20 for fixing the multiple monochromatic toner images, which are different in color and have just been transferred onto the sheet S, to the sheet S. This fixing portion 20 has a heat roller 21*a* and a pressure roller 21*b*. The pressure roller 21*b* is kept pressed upon the heat roller 21*a* to apply heat and pressure to the sheet S. Therefore, while the sheet S is conveyed through the fixing portion 20 after the transfer of the toner images on the photosensitive drums 1, the sheet S is subjected to heat and pressure while being conveyed by the fixation rollers 21. As a result, the toner images, different in color, on the sheet S are fixed to the surface of the sheet S.

In an image forming apparatus, the cartridges 7*a*, 7*b*, 7*c*, and 7*d* for Y, M, C, and BK colors, respectively, are sequentially driven in synchronization with the printing timing. As cartridges 7 are driven, the photosensitive drums 1*a*, 1*b*, 1*c*, and 1*d* in the cartridges 7*a*, 7*b*, 7*c*, and 7*d*, respectively, rotate in the counterclockwise direction. With the same timing as the cartridges 7*a*, 7*b*, 7*c*, and 7*d*, the scanner units 3*a*, 3*b*, 3*c*, and 3*d* are sequentially driven, and the charge rollers 2*a*, 2*b*, 2*c*, and 2*d* uniformly charge the peripheral surface of the photosensitive drums 1*a*, 1*b*, 1*c*, and 1*d*, respectively. The scanner units 3*a*, 3*b*, 3*c*, and 3*d* expose the charged areas of the peripheral surfaces of the photosensitive drums 1*a*, 1*b*, 1*c*, and 1*d* in accordance with the picture signals. As a result, an electrostatic latent image is effected on the charged area of the peripheral surface of each of the photosensitive drums 1*a*, 1*b*, 1*c*, and 1*d*. The development rollers 40*a*, 40*b*, 40*c*, and 40*d* transfer toner onto the numerous low potential level points of the electrostatic latent image; they develop (form) toner images on the photosensitive drums 1*a*, 1*b*, 1*c*, and 1*d*.

The rotation of the pair of registration rollers 19 is started with such a timing that the arrival of the leading edge of the toner image formed on the peripheral surface of the most upstream photosensitive drum 1, that is, photosensitive drum la, at the interface between the peripheral surface of the photosensitive drum 1*a* coincides with the arrival of the printing (writing) start line of the sheet S at the interface, and the sheet S is conveyed to the electrostatic transfer belt 11. After being released by the pair of registration rollers 19, the sheet S is conveyed between an electrostatic adhesion roller 22 and the electrostatic transfer belt 11, while remaining pinched by the roller 22 and belt 11, being thereby pressed upon the outward surface of the electrostatic transfer belt 11 in terms of the aforementioned belt loop. Further, while the sheet S is conveyed between the rollers 22 and belt 11, voltage is applied between the sheet S and electrostatic transfer belt 11, inducing thereby electric charge between the sheet S and electrostatic transfer belt 11, which are dielectric. As a result, the sheet S is electrostatically adhered to the outward surface of the electrostatic transfer belt 11, ensuring that the sheet S remains satisfactorily adhered to the electrostatic transfer belt 11 while it is conveyed to the most upstream transfer portion.

While the sheet S is conveyed as described above, the toner images are sequentially transferred onto the sheet S by the electric fields formed between the photosensitive drums 1*a*, 1*b*, 1*c*, and 1*d* and transfer rollers 12*a*, 12*b*, 12*c*, and 12*d*, respectively. After the transfer of the Y, M, C, and BK color toner images onto the sheet S, the sheet S is separated from the electrostatic transfer belt 11 by the curvature of the belt driver roller 13, and is conveyed into the fixing portion 20, in which the toner images are thermally fixed. After the fixation of the toner images, the sheet S is discharged from the printer main assembly 100, with its image bearing surface facing downward, through the sheet discharge portion by a pair of sheet discharge rollers 23.

(Process Cartridge)

Figure 3:
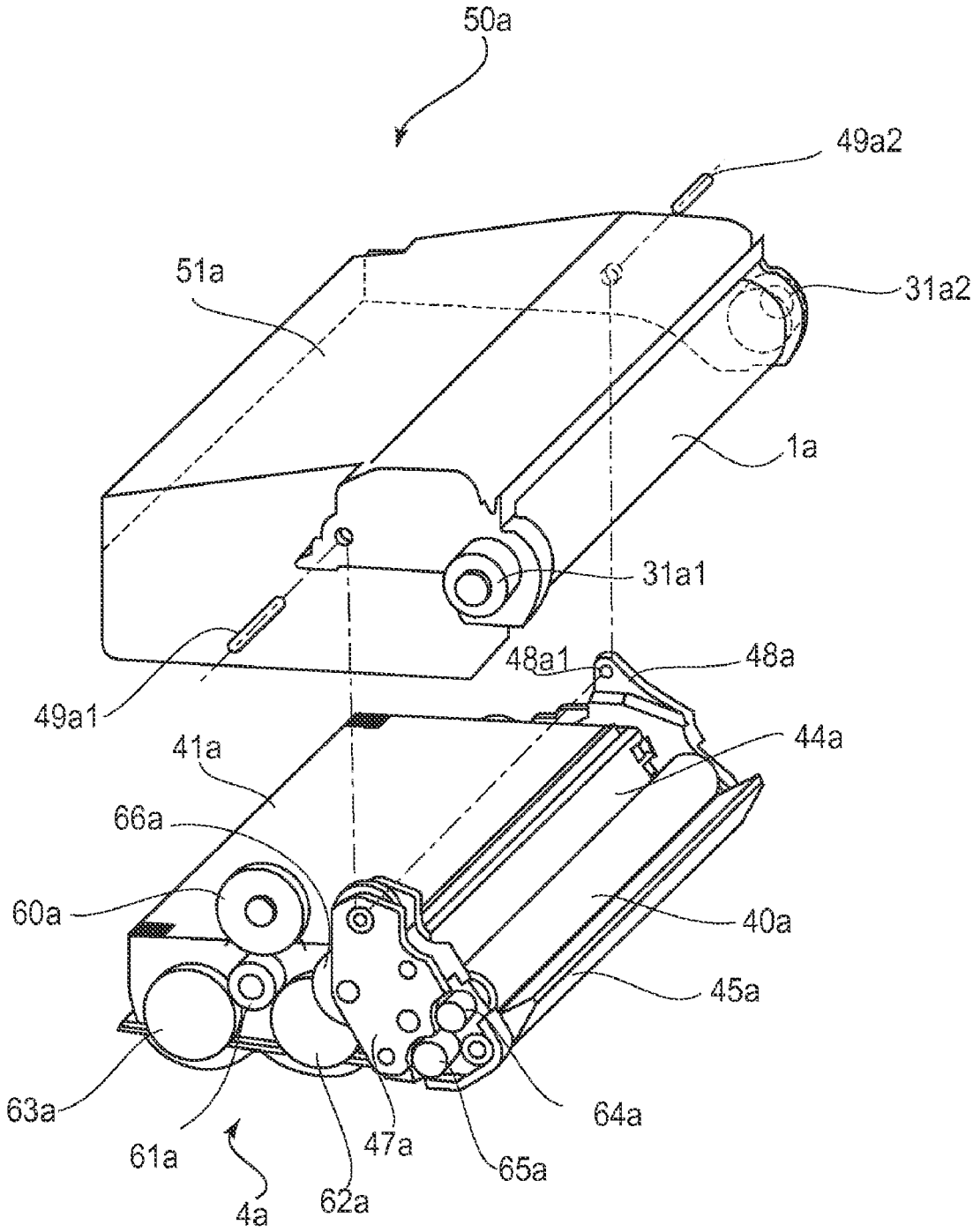
FIG. 3 is a partially exploded perspective view of the process cartridge in the first embodiment.

The cartridges 7*a*, 7*b*, 7*c*, and 7*c* shown in FIGS. 2 and 3 are the same in structure. Thus, the cartridge 7 will be described with reference to the cartridge 7*a*. The cartridge 7*a* is an integration of the photosensitive drum 1*a*, and the processing means, such as the charging apparatus 2*a*, developing apparatus 4*a*, and cleaning apparatus 6*a*, etc. In this embodiment, the cartridge 7*a* is made up of a photosensitive drum unit 50*a* (image bearing member, and a developing apparatus 4*a*.

First, the photosensitive drum unit 50*a* will be described.

Figure 10:
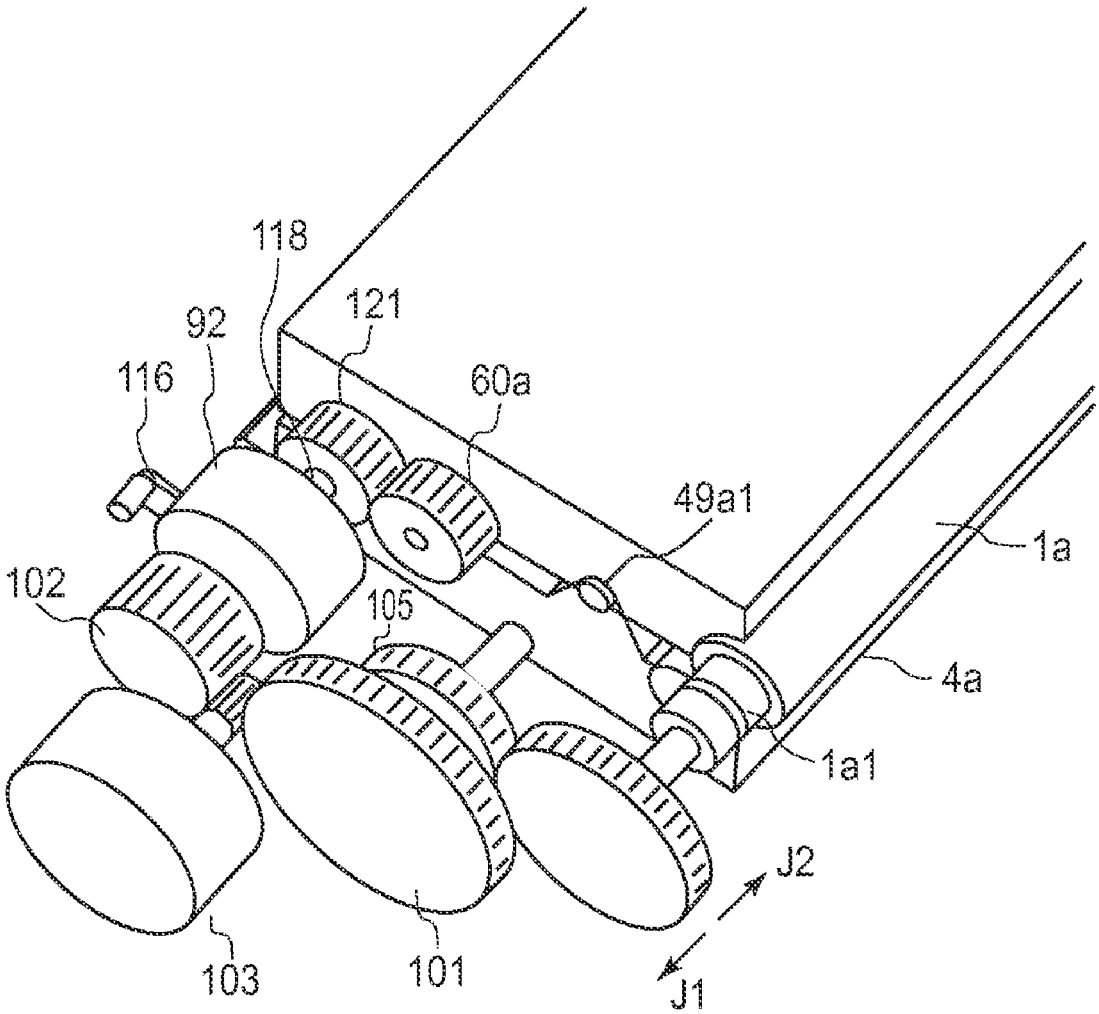
FIG. 10 is a perspective view of the process cartridge driving portion in the first embodiment.

The photosensitive drum 1*a* is rotatably supported by a cleaning means frame 51, with bearings 31*a*1 and 31*a*2 placed between the photosensitive drum 1 and frame 51. Referring to FIG. 10, when the cartridge 7*a* is mounted into the printer main assembly 100, a coupler 1*a*1 with which one of the lengthwise ends of the photosensitive drum 1*a* is provided engages with the coupler 107 on the main assembly side, making it possible for the rotational force of a motor 103 to be transmitted to the photosensitive drum 1*a* through the coupling 107 to rotate the photosensitive drum 1*a* in the counterclockwise direction for image formation. In the adjacencies of the peripheral surface of the photosensitive drum 1*a*, the charging apparatus 2*a* and cleaning blade 6*a* are disposed in contact with the peripheral surface of the photosensitive drum 1*a*. The cleaning blade 6*a* is disposed so that as the photosensitive drum 1*a* is rotated, it removes the toner remaining on the peripheral surface of the photosensitive drum 1*a* by scraping the peripheral surface of the photosensitive drum 1*a*. As the residual toner is removed by the cleaning blade 6*a*, it is sent by a residual toner sending mechanism to a waste toner chamber 53*a* located in the rear portion of the cleaning means frame 51*a*.

The developing apparatus 4*a* is made up of the development roller 40*a*, as a developing means, which rotates in contact with the photosensitive drum 1*a* in the direction indicated by an arrow symbol Y, a toner container 41*a*, developing means frame 54*a*, etc. The development roller 40*a* is rotatably supported, by its axle, by the developing means frame 45*a*, with the bearing disposed between its axle and the developing means frame 45*a*. The developing apparatus 4*a* is also provided with a toner supply roller 43*a*, which rotates in contact with the peripheral surface of the development roller 40*a* in the direction indicated by an arrow mark Z, and a development blade 44*a*. Within the toner container 41*a*, a toner moving mechanism 42*a* is provided, which is for feeding the toner supply roller 43*a* with the by moving the toner toward the toner supply roller 43*a* while stirring the toner. Also referring to FIG. 10, when the cartridge 7*a* is mounted into the printer main assembly 100, a gear 60*a* with which the developing apparatus 4*a* is provided engages with a gear 121 on the apparatus main assembly side, making it possible for the rotational force of the motor 103 to rotate the supply roller 43*a*, by being transmitted from the gear 60*a* to a gear 65*a* with which one of the lengthwise ends of the supply roller 43*a* is provided, through a gear 61*a*, 62*a*, and 63*a* with which the developing apparatus 4*a* is provided. The gear 65*a* is in mesh with the gear 64*a* with which one of the lengthwise ends of the development roller 40*a* is provided. Therefore, the rotational force is transmitted to the development roller 40*a*, rotating thereby the development roller 40*a*.

The cartridge 7*a* is structures so that the entirety of the developing apparatus 4*a* is allowed to rotate relative to the photosensitive drum unit 50*a*, in an oscillatory fashion, about the axial line of the joint between the developing apparatus 4*a* and photosensitive drum unit 50*a*. That is, at one of the lengthwise ends of the cartridge 7*a*, a pin 49*a*1 is fitted in a hole 51*a*1 with which the cleaning means frame 51*a* is provided, and a supportive hole 47*a*1 with which a bearing member 47*a* of the developing apparatus 4*a* is provided, whereas at the other lengthwise end of the cartridge 7*a*, a pin 49*a*2 is fitted in a hole 51*a*2 with which the cleaning means frame 51*a* is provided, and a supportive hole 48*a*1 with which a bearing member 48*a* of the developing apparatus 4*a* is provided.

Before the cartridge 7*a* is mounted into the printer main assembly 100, that is, while the cartridge 7*a* is left alone outside the printer main assembly 100, the developing apparatus 4*a* remains kept pressed by a compression spring 54*a* so that the development roller 40*a* remains kept in contact with the photosensitive drum 1*a*. The toner container 41*a* is provided with a rib 46*a*, which protrudes outward from the external surface of the toner container 41*a*. That is, a development roller separating mechanism, with which the printer main assembly 100 is provided comes into contact with the rib 46*a* and pushes it up, causing the development roller 40*a* to separate from the photosensitive drum 1*a*. The development roller separating mechanism will be described next.

(Development Roller Separating Mechanism)

Figure 6:
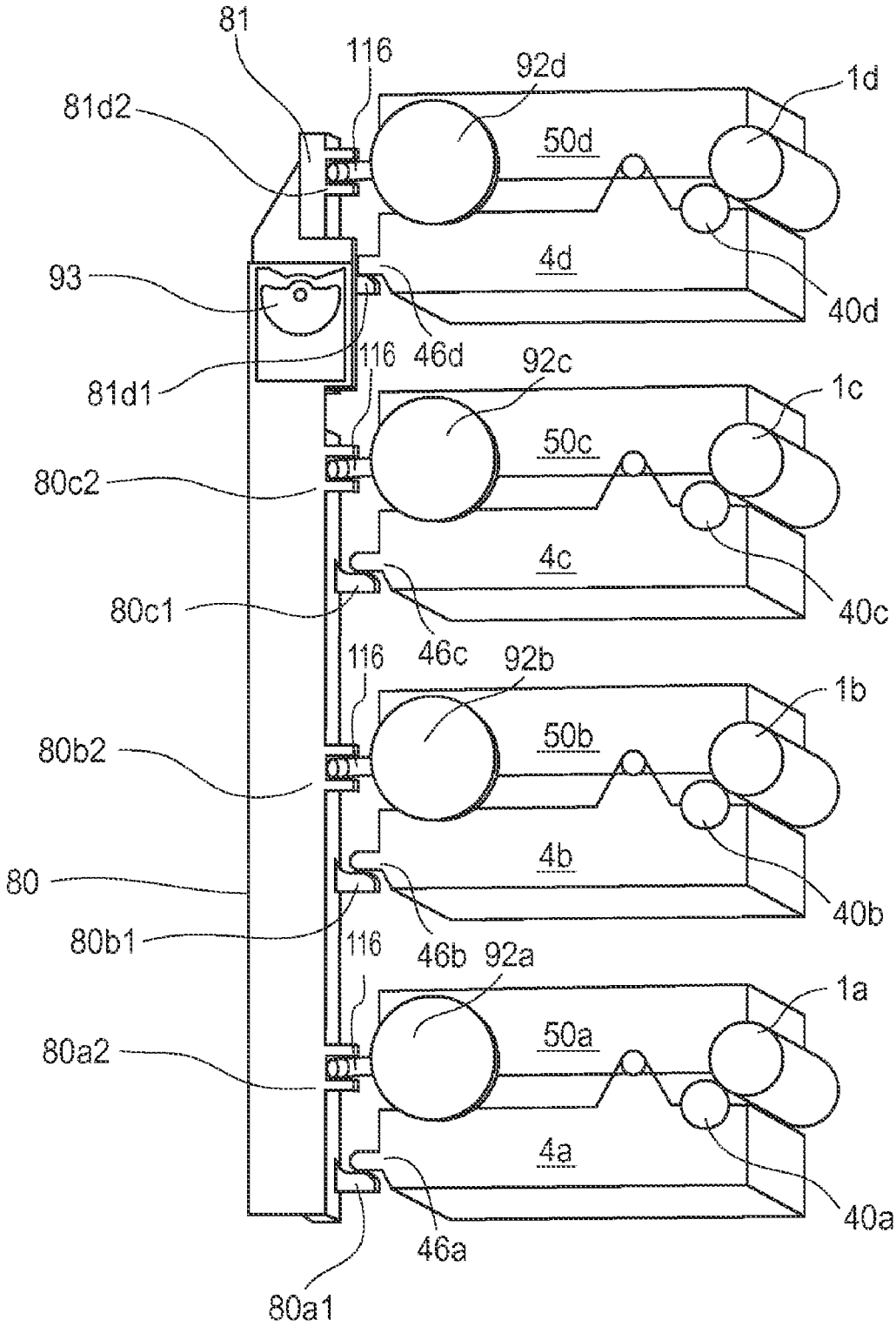
FIG. 6 is an oblique sectional view of all the process cartridge bays, and all the process cartridges therein, in which the cartridge has been separated from the photosensitive drum.

At this time, referring to FIGS. 6-8, the development roller separating mechanism (separating means) with which the printer main assembly 100 is provided will be described.

The development roller separating mechanism, which is made up of various members, which will be described next, is located in the rear portion in the printer main assembly 100. It separates the development rollers 40*a*, 40*b*, 40*c*, and 40*d* from the photosensitive drums 1*a*, 1*b*, 1*c*, and 1*d*, respectively, against the force generated by the resiliency of the abovementioned springs.

Figure 8:
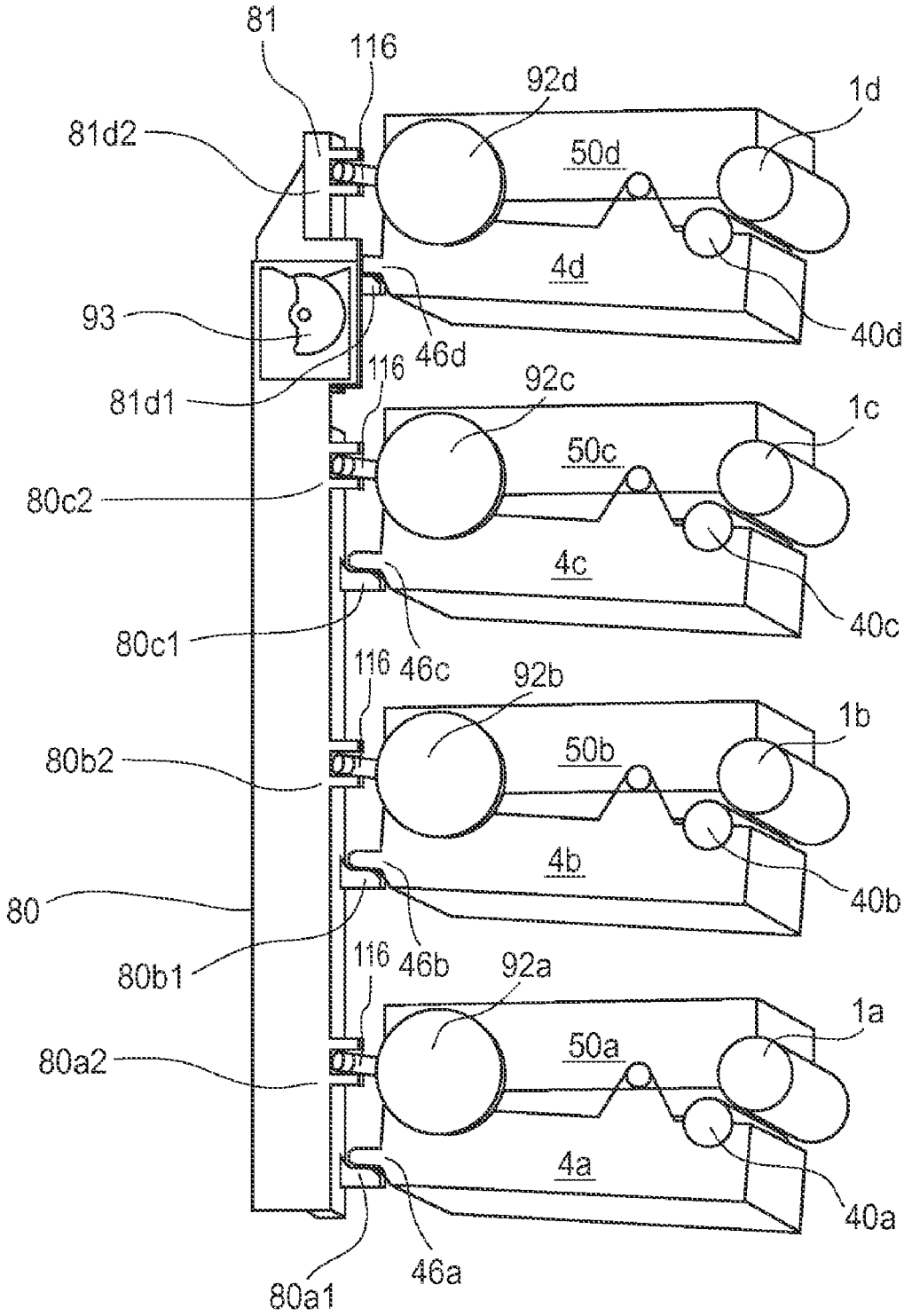
FIG. 8 is a schematic perspective view of the process cartridges in the apparatus main assembly, and their adjacencies, showing that the development rollers in all cartridges are remaining separated from the corresponding photosensitive drums.
Figure 9:
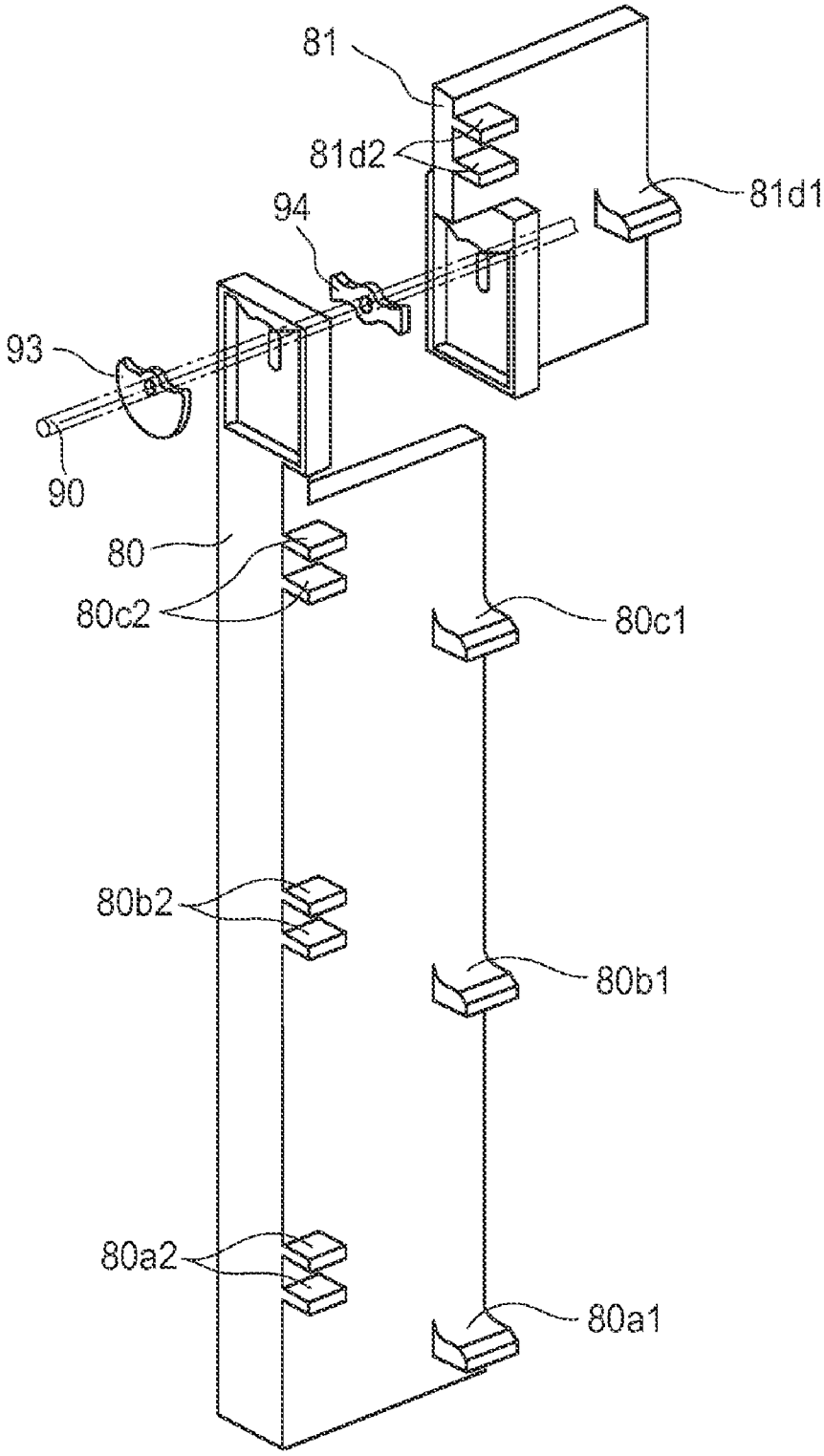
FIG. 9 is a perspective view of the cams and development roller separating plates in the first embodiment.

First, referring to FIGS. 8 and 9, the printer main assembly 100 is provided with first and second plates 81 and 80, as the first and second members, respectively, for pushing up the ribs 46*a*, 46*b*, 46*c*, and 46*d* with which the developing apparatuses 4*a*, 4*b*, 4*c*, and 4*d* are provided, respectively. The first plate 81 is involved with only the developing apparatus 4*d*, that is, the developing apparatus containing the black toner. The second plate 80 is involved with the developing apparatuses other than the developing apparatus containing black (BK) toner, that is, the developing apparatuses 4*a*, 4*b*, and 4*c* containing yellow (Y), magenta (M), and cyan (C) toners, respectively.

The second plate 80 is provided with first engaging portions 80*a*1, 80*b*1, and 80*c*1, which are in the form of a protrusion, and second engaging portions 80*a*2, 80*b*2, and 80*c*2, each of which is made up of a pair of protrusions. The first and second engaging portions perpendicularly protrude from the surface of the second plate 80. As the second plate 80 is vertically moved upward, the first engaging portions 80*a*1, 80*b*1, and 80*c*1 move upward, pushing up the ribs 46*a*, 46*b*, and 46*c*, respectively, of the developing apparatuses 4*a*, 4*b*, and 4*c*, respectively. As a result, the developing apparatuses 4*a*, 4*b*, and 4*c* rotate about the abovementioned pins 49*a*1 and 49*a*2, causing the development roller 40*a*, 40*b*, and 40*b*, which are in the leading end portions of the development units 4*a*, 4*b*, and 4*c*, to separate from the photosensitive drums 1*a*, 1*b*, and 1*c*, respectively. Hereafter, these positions in which developing apparatuses 4*a*, 4*b*, and 4*c* are after the development rollers 40*a*, 40*b*, and 40*c* are separated from the photosensitive drums 1*a*, 1*b*, and 1*c*, respectively, will be referred to as separation positions.

On the other hand, as the second plate 80 is moved downward, the second engaging portions 80*a*2, and 80*b*2, and 80*c*2 come into contact with the levers portions 116*a*, 116*b* and 116*c* of clutch controlling members 116, with which clutches 92*a*, 92*b*, and 92*c* (driving force transmission controlling means) are provided, and move them downward, connecting thereby the clutches 92 so that the rotational force from the motor 103 is transmitted to each of the developing apparatuses 4*a*, 4*b*, and 4*c*. The clutch 92 will be described later in more detail. The levers portion 116*a* of clutch controlling member 116 extends from the clutch 92 in the direction perpendicular to the axial line of the clutch 92. The first plate 81 is provided with a first engaging portion 81*d*1, and a second engaging portion 81*d*2 which is made up of a pair of protrusions. The roles which the first and second engaging portions 81*d*1 and 81*d*2, respectively, of the first plate 81 play are the same as those which the first and second engaging portions of the second plate 80 play.

Referring to FIG. 10, the first and second plates 81 and 80 vertically move upward or downward by receiving the rotational force from the motor 103 as a driving force source. More specifically, referring to FIG. 9, a shaft 90 is rotated by the driving force from the motor 103, transmitting thereby the driving force to cams 94 and 93, as first and second cams, respectively, which are solidly attached to the shaft 90 and are shaped and positioned to move upward or downward the plates 81 and 80, respectively.

(Cartridge Driving Mechanism)

FIG. 10 shows the mechanism for driving the cartridges.

This driving mechanism is provided with multiple motors 103, which are for driving the cartridges 7*a*, 7*b*, 7*c*, and 7*d*, one for one. The driving force outputted by each motor 103 is divided into two portions; it is transmitted to a drum gear 101 which drives the photosensitive drum 1, and a gear 102 which is a part of the clutch through which the driving force is transmitted to the development roller 40. The rotational shaft attached to the gear 102 is provided with clutch 92 (92*a*, 92*b*, 92*c*, or 92*d*). Thus, even when the photosensitive drum 1 is rotating, the transmission of the driving force to the development roller 40 can be interrupted or restored.

The engagement or disengagement of the clutch 92 is achieved by moving upward or downward the first and second plates 81 and 80. That is, the clutch 92 becomes engaged or disengaged as the engaging portions 80*a*2, 80*b*2, 80*c*2, and 80*d*2 push up or down the levers portions 116*a*, 116*b*, 116*c*, and 116*d* of the clutch controlling members 116 of the clutches 92*a*, 92*b*, 92*c*, and 92*d*, respectively. That is, when the lever portion 116*a* (116*b*, 116*c*) is in the top position into which it is pushed up, the clutch 92 remains disengaged, and therefore, the rotational force of the motor 103 is not transmitted to the development roller 40, and also, the developer roller 40 remains separated from the photosensitive drum 1. Hereafter, the state of the first and second plates 81 and 80, in which the clutch 92 remains disengaged as described above will be referred to as non-operational state.

On the contrary, when the lever portion 116*a* is in the bottom position into which it is pushed down, the clutch 92*a* remains engaged, and therefore, the rotational force of the motor 103 is transmitted to the development roller 40, rotating thereby the development roller 40, and also, the developer roller 40 remains in contact with the photosensitive drum 1. Incidentally, when the image forming apparatus is in the standby mode, shown in FIG. 8, which will be described later in more detail, the first and second plates 81 and 80 are in the top positions into which they are pushed up, and the development rollers 40*a*, 40*b*, 40*c*, and 40*d*, which correspond to Y, M, C, and BK colors, respectively, remain separated from the photosensitive drums 1*a*, 1*b*, 1*c*, and 1*d*, respectively. In this mode, the clutches 92*a*, 92*b*, 92*c*, and 92*d* remain disengaged. Hereafter, the state of the first and second plates 81 and 80, in which the clutches 92 remain disengaged as described above will be referred to as operational state.

(Clutch)

Figure 16:
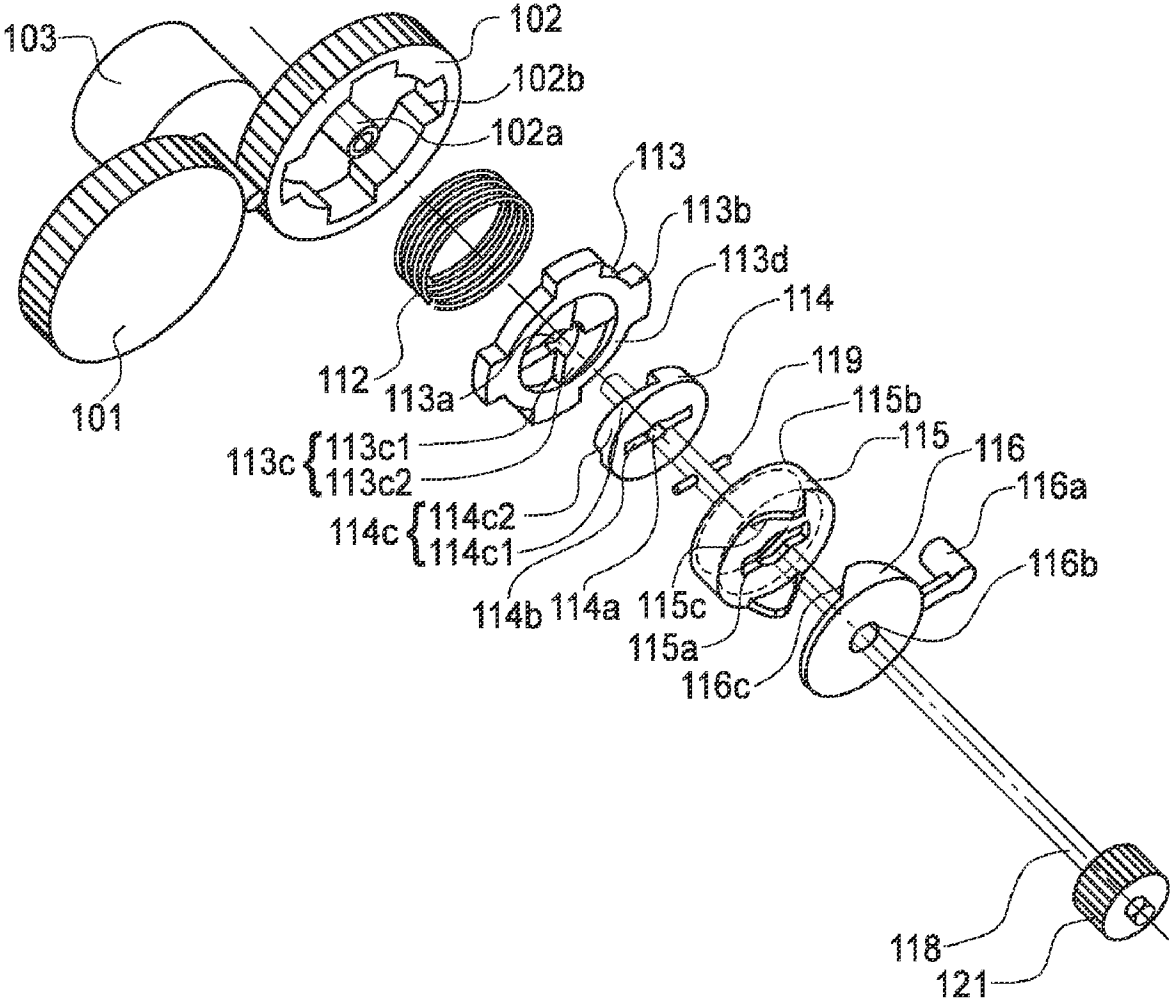
FIG. 16 is a perspective exploded view of one of the development roller clutches.

Next, referring to FIG. 16, the details of the clutch 92*a* of the driving apparatus will be described.

The gear 102, which meshes with the gear attached to the output shaft of the motor 103, is rotatably fitted around a shaft 118. The positional relationship between the gear 102 and shaft 118 in terms of the direction of the axial line of the shaft 118 is preset. The gear 102 is hollowed on the opposite side from the motor 103, except for the boss 102*a*, which is located at the center of the gear 102 in terms of the radius direction of the gear 102. The internal surface of the boss 102*a* constitutes the surface by which the gear 102 slide on the rotational shaft 118 (driving force receiving side) to be accurately positioned in terms of the axial direction of the shaft 118 and/or rotate around the shaft 118. The peripheral surface of the boss 102*a* constitutes the surface on which the coupler 113 slides to be accurately positioned in terms of the axial direction of the coupler 113 (boss 102*a*) and/or rotate. The lateral wall of the hollow of the gear 102 is provided with four rotation control recesses 102*b*, which constitute means for preventing the coupler 113 from rotating relative to the gear 102 while the coupler 113 is in the abovementioned hollow of the gear 102.

The coupler 113 has four protrusions 113*c* which protrude from its peripheral surface. The coupler 113 is shaped so that it fits in the hollow of the gear 102, while being allowed to slide in the axial direction of the gear 102 (coupler 113). As the rotation control protrusions 113*b* on the peripheral surface of the coupler 113 fit in the rotation control recesses 102*b*, one for one, of the gear 102, the coupler 113 rotates with the gear 102. Further, the coupler 113 is provided with four protrusions 113*c*, whereas the coupler 114 on the driving force receiving side is provided with protrusions 114*c*. Thus, the meshing between the protrusions 113*c* and protrusions 114*c* makes it possible for the above-mentioned rotational force to be transmitted.

The driving force transmitting surface 113*c*1 of each protrusion 113*c* is slanted so that as the coupler 113 is rotated, the component in contact with the surface 113*c*1 is pulled toward the coupler 113. Thus, it is assured that as the clutch 92 is engaged, the gear 102 engages with the coupler 113, and also, that even if a large amount of torque bears on the gear 102, "skipping" does not occur. Further, the adjacent driving force transmitting surfaces 113*c*1 are connected with a gently slanted surface 113*c*2. Therefore, even when the clutch 92 is engaged while the gear 102 is rotating, the engagement occurs very smoothly.

A surface 113*d* of the coupler 113, which is on the opposite side from the motor 103 constitutes the surface which rubs a release ring 115 (which will be described later) in the rotational direction. The coupler 113 is kept pressed toward the coupler 114, that is, the coupler on the driving force receiving side, by a coil spring 112, that is, an elastic member.

The coupler 114 is provided with a center hole and a groove 114*b*. The groove 114*b* extends in the diameter direction of the coupler 114, and the center of the groove 114*b* in terms of the diameter direction of the coupler 114 coincides with the axial line of the center hole. The shaft 118 fits in the center hole, and a pin 119 fits in the groove 114*b*. The coupler 114 is provided with the above-mentioned four protrusions 114*c*. When these protrusions 114*c* are in engagement with the protrusions 113*c* of the coupler 113, one for one, the above-mentioned driving force can be transmitted. The driving force transmitting surface 114*c*1 of each protrusion 114 is slanted so that as the coupler 113 is rotated, the coupler 114 is pulled into the coupler 113. Further, the adjacent two driving force transmitting surfaces 114*c*1 are connected by a gently slanted surface 114*c*2. Further, the coupler 113, coupler 114, and coil spring 112 are fitted in the abovementioned hollow of the gear 102, to reduce the size of the image forming apparatus by more effectively using the internal space of the apparatus main assembly. In addition, the rotational force transmitted through the surface of each tooth of the gear 102 is transmitted straightly inward of the cartridge 7. Therefore, it does not occur that such force that acts in the direction to twist and/or fell the couplers is generated. Thus, the above described structural design makes it easier to ensure that the abovementioned components are strong enough for their roles, and also, to transmit a substantially larger amount of torque than that transmittable by couplers in accordance with the prior art.

A clutch controlling member 116 is fitted around the shaft 118 so that it is rotatable about the shaft 118. The engagement between the lever portion 116*a* and the second engaging portion 80*a*2 (80*b*2, 80*c*2) causes the clutch controlling member 116 to rotate. The clutch controlling member 116 is provided with a cam portion 116*c*, which comes into contact with the cam portion 115*c* of the release ring 115 to move the release ring 115 in the direction of the axial line. The release ring 115 is provided with multiple pairs of cam portions 115*a*, the cam portions in each pair being symmetrically positioned with reference to the axial line of the release ring 115, and the clutch control lever are provided multiple pairs of cam portions 116*a*, the cam portions of each pair being symmetrically positioned with reference to the axial line of the clutch controlling member 116.

While the cam portions 116*c* of the clutch controlling member 116 are in contact with the cam portions 115*c* of the release ring 115, the release ring 115 is kept pressed toward the gear 102. That is, the surface 115*b* of the release ring 115 comes into contact with the surface 113*d* of the coupler 113, pushing the coupler 113 away from the coupler 114 against the spring 112, making it impossible for the rotational force from the motor 103 to be transmitted to the shaft 118.

On the other hand, the cam portions 116*c* of the clutch controlling member 116 can be separated from the cam portions 115*c* of the release ring 115, by rotating the clutch controlling member 116. While the cam portions 116*c* of the clutch controlling member 116 remain separated from the cam portion 115*c* of the release ring 115, the release ring 115 moves toward the gear 121, that is, the gear on the driving force receiving side. Here, referring to FIGS. 3 and 10, the gear 121 is a gear which transmits the rotational force to the developing apparatus 4*a* by meshing with the gear 60*a*, with which the developing apparatus 4*a* is provided, when the cartridge 7*a* is in the printer main assembly 100. That is, the coupler 113 is pressed by the pressure generated by the resiliency of the spring 112, being thereby caused to engage with the coupler 114. Thus, the rotational force from the motor 103 is transmitted to the shaft 118. Incidentally, the clutch 92*a* may be modified in structure so that the couplers 114, or the coupler on the driving force receiving side, and the coupler 113, or the coupler on the driving force transmitting side, are switched in position. The structures of other clutches 92*b*, 92*c*, and 92*d* are the same as the above described structure of the clutch 92*a*.

(Driving Force Transmission to Mode Switching Member)

Figure 11:
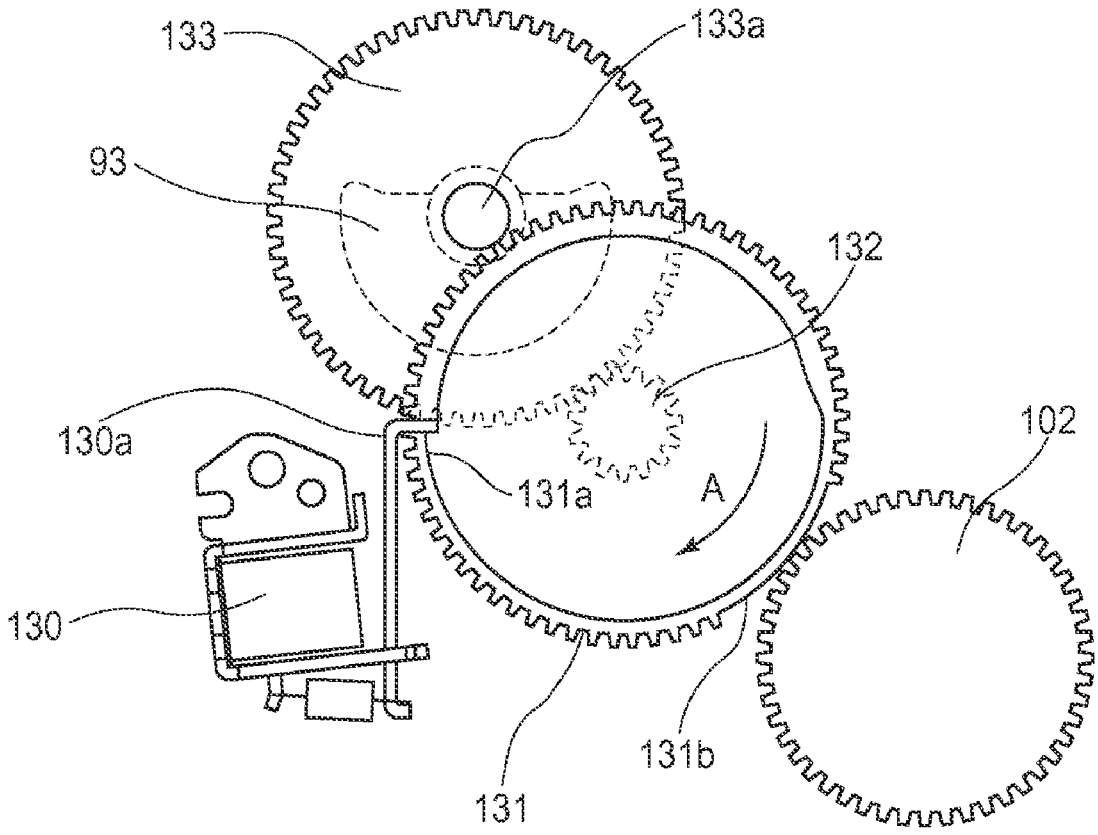
FIG. 11 is a side view of the gear train in this embodiment, showing the role of the gear with a toothless range (which hereafter may be referred to as partially toothless gear).

Referring to FIG. 11, to the cams 93 and 94, the driving force is transmitted through the gear 102. That is, the rotational force of the gear 102 is first transmitted to a gear 131 with a toothless range (third clutch), and then, is transmitted to a cam gear 133 through a gear 132 which is on the same axle as the gear 131 with a toothless range. The gear 133 is provided with a shaft 133*a* which rotates with the gear 133. It is to this shaft 133*a* that the cams 93 and 94 are attached. Thus, as the gear 133 rotates, the cams 93 and 94 also rotate. The gear 131 with a toothless range is provided with an engaging portion 131*a*, with which the lever 130*a* of a solenoid 130 as the actuator of the third clutch engages. While the lever 130*a* is in engagement with this engaging portion 131*a*, the gear 131 with a toothless range remains stationary, with its toothless range 131*b* opposing the gear 102. Therefore, while the lever 130*a* is in engagement with the engaging portion 131*a*, the rotational force of the gear 102 does not transmit to the gear 131 with a toothless range. However, as the solenoid 130 is activated, and therefore, the lever 130*a* is pulled, the lever 130*a* is disengaged from the engaging portion 131*a*, making it possible for the gear 131 with a toothless range to rotate. Since gear 131 with a toothless range is kept pressured to rotate in a direction A, the gear 131 with a toothless range rotates in the direction A, meshes again with the gear 102, being thereby rotated by the gear 102. Then, as the following full rotation of the gear 131 with a toothless range causes the lever 130*a* to engage with the engaging portion 131*a*, the rotation of the gear 131 with a toothless range stops.

The gears 132 and 133 are designed so that a single full rotation of the gear 132 causes the gear 133 to rotate 90°. Thus, a single full rotation of the gear 132 changes the rotational phase of the cam 93 by 90°.

Figure 12:
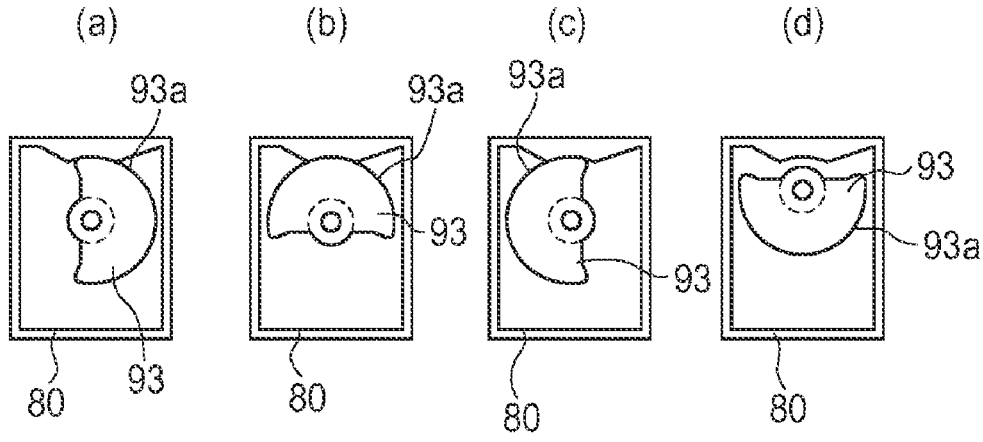
FIG. 12 is a schematic side view of one of the cams in the first embodiment, showing the movement of the cam.

FIGS. 12(*a*)-12(*d*) are drawings for showing the states in which the first cam 93 for moving upward or downward the second plate 80 which is involved with three colors Y, M, and C, can be. That is, each time the solenoid 130 is activated, the cam 93 is rotated by 90°, causing the separation plate 80 to move upward or downward, because of the profile of the cam 93. Incidentally, the relationship between the first plate 81, which is involved with black color, and the cam 94, is the same as the above described relationship between the second plate 80 and cam 93.

That is, when the cam 93 is in the state shown in FIG. 12(*a*), the second plate 80 is in contact with the cam surface 93*a* of the cam 93, being thereby held at its highest position. Each time the lever 130*a* of the solenoid 130 is pulled, the cam 93 rotates by 90°. Also when the cam 93 is in the state shown in FIG. 12(*b*) or 12(*c*), the second plate 80 is in contact with the cam surface 93*a* of the cam 93, being thereby held at its highest position as in the state shown in FIG. 12(*a*). However, as the cam 93 moves into the position shown in FIG. 12(*d*), the cam surface 93*a* of the cam 93 becomes separated from the second plate 80, allowing the second plate 80 to move downward. The cam 94, which is for moving the first plate 81 for the BK color, is contoured as shown in FIG. 9. Therefore, each time the cam 94 rotates by 90°, it changes the position of the first plate 81. As described above, the positions of the first and second plates 81 and 80 are changed by the rotation of the cams 93 and 94, respectively.

Figure 17:
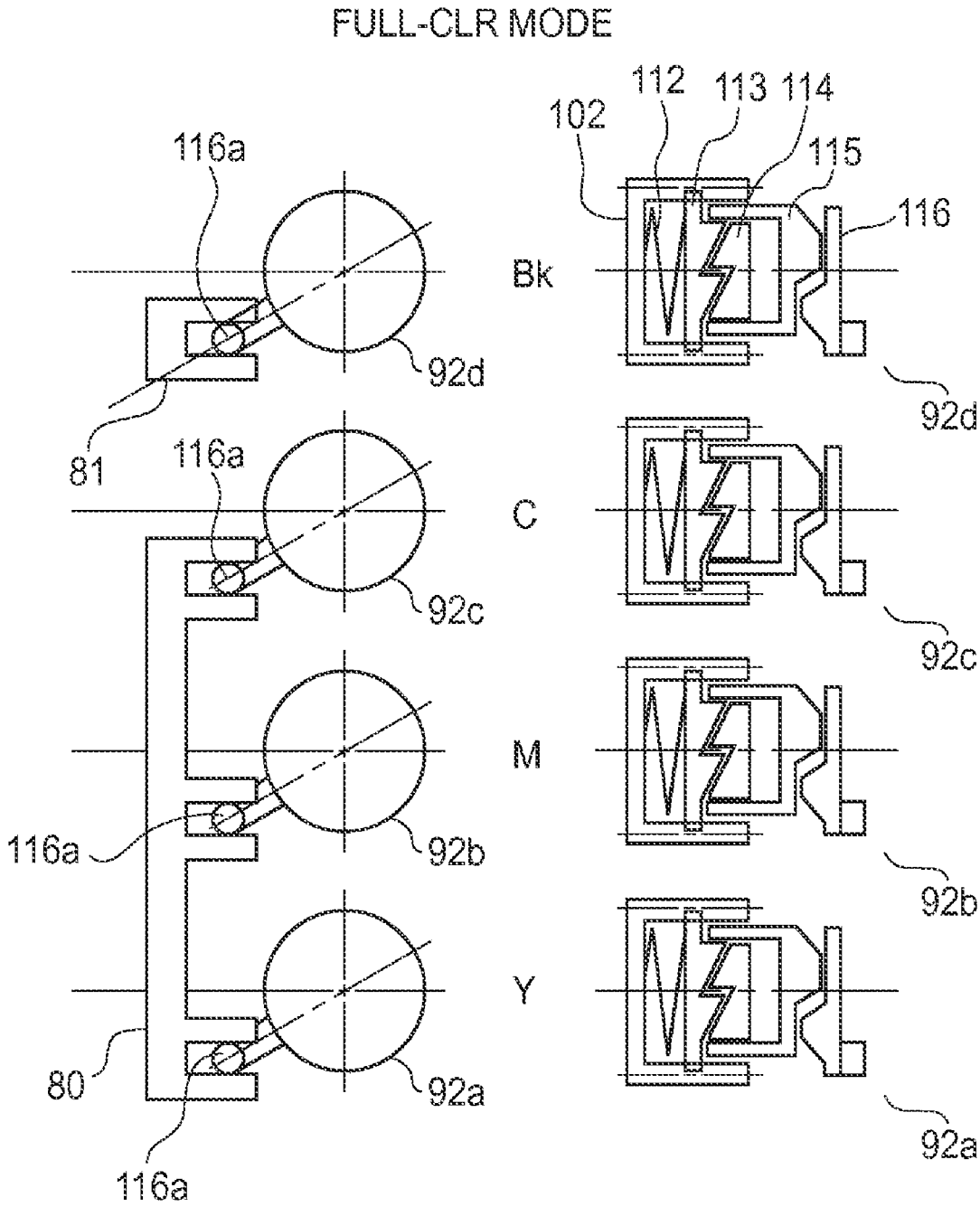
FIG. 17 is a schematic drawing of the development roller separating mechanism in the full-color mode.

At this time, referring to FIG. 6, an image forming operation carried out by the image forming apparatus when the apparatus is in the full-color mode will be described. When the image forming apparatus is in the full-color mode, the developing process is carried out by all the developing apparatuses 40*a*, 40*b*, 40*c*, and 40*d*, which correspond to Y, M, C, and BK colors, respectively. In other words, if the first and second plate 81 and 80 are being held at their top positions by the cams 93 and 94 when the image forming operation is started, the cams 93 and 94 are rotated into the positions in which they cannot contact the first and second plates 81 and 80, respectively. Thus, the development roller 40*a*, 40*b*, 40*c*, and 40*d* come into contact with the photosensitive drums 1*a*, 1*b*, 1*c*, and 1*d*, respectively. Also in the full-color mode, the clutches 92*a*, 92*b*, 92*c*, and 92*d* are in the states shown in FIG. 17, in which the cam portions 116*c* of the clutch controlling member 116 are not in contact with the cam portions 115*c* of the release ring 115, and therefore, the coupler 113 is kept engaged with the coupler 114 by the pressure generated by the resiliency of the spring 112. Therefore, the rotational force from the motor 103 is transmittable to each of the development rollers 40*a*, 40*b*, 40*c*, and 40*d*.

Figure 7:
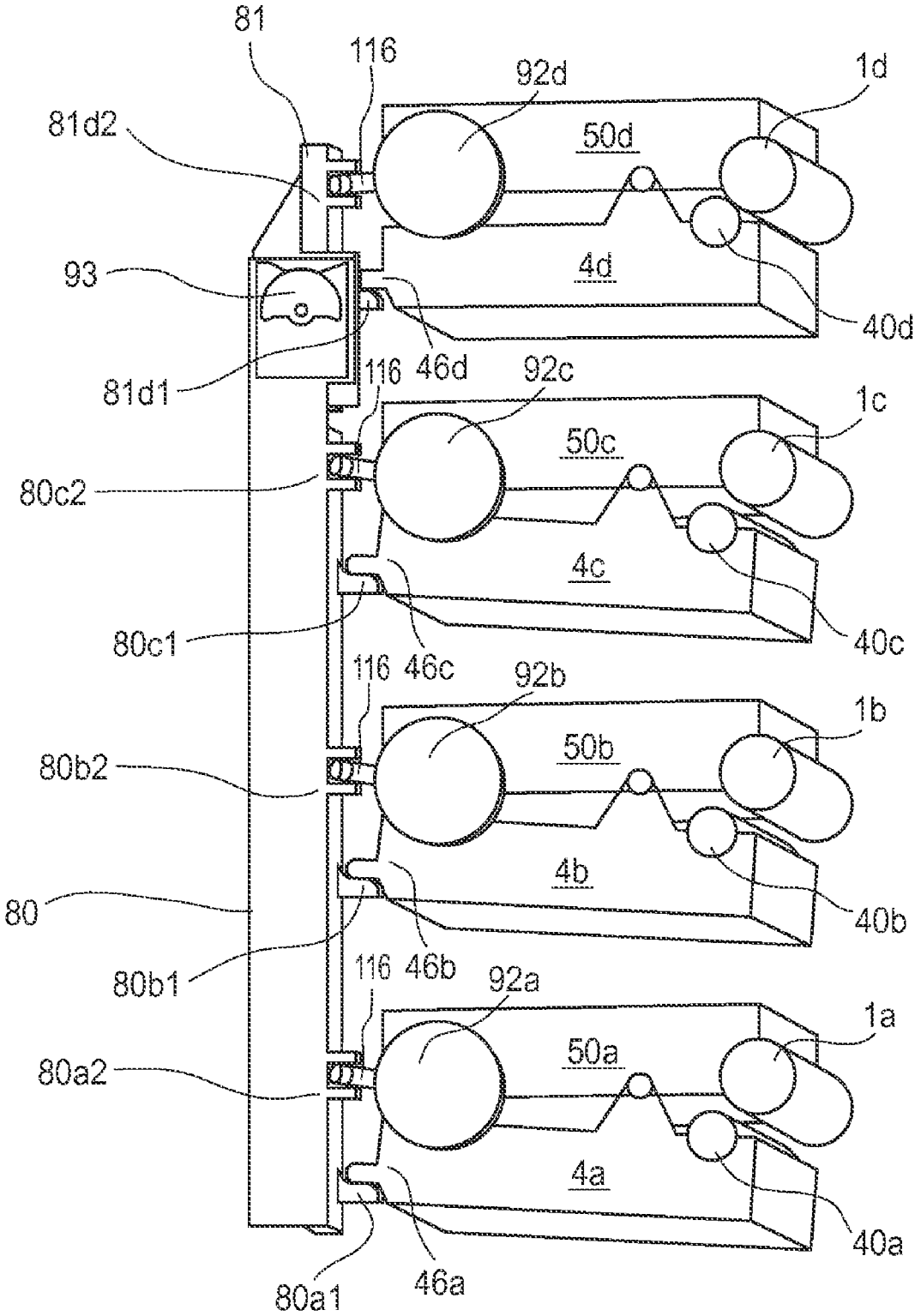
FIG. 7 is a schematic perspective view of the process cartridges in the apparatus main assembly, and their adjacencies, showing that the development roller of the cartridge for black color is in contact with the corresponding photosensitive, whereas the development roller in each of the cartridges for yellow, magenta, and cyan colors, is remaining separated from the corresponding photosensitive drum.
Figure 18:
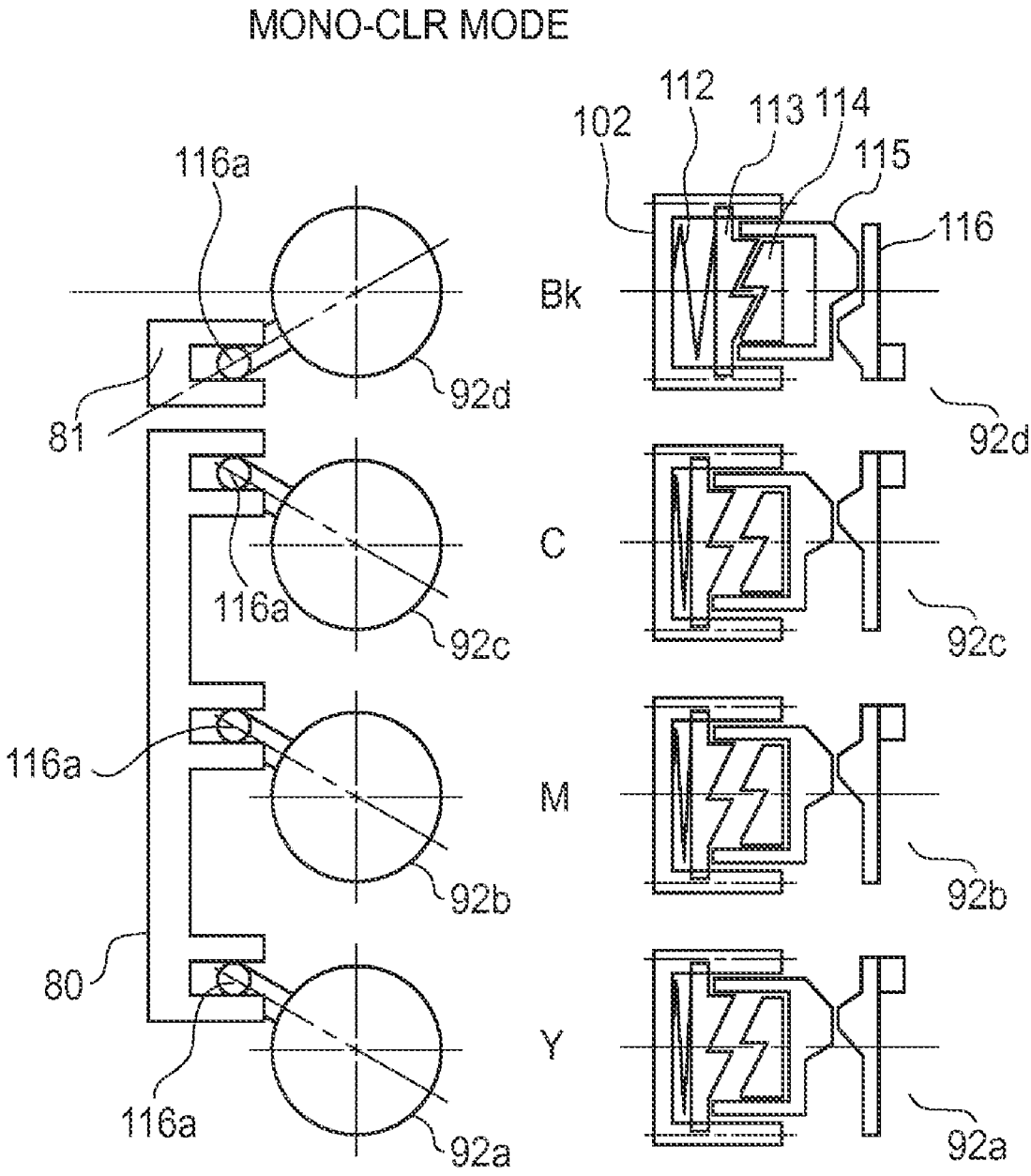
FIG. 18 is a schematic drawing of the development roller separating mechanism in the black-and-white mode.

FIG. 7 shows the states of the essential portions of the image forming apparatus which is in the black-and-white mode in which the development process is carried out only by the developing apparatus 4*d* for the black color. In this mode, the second plate 80 is kept in its top position, into which it is pushed up by the cam 93, to keep the development rollers 40*a*, 40*b*, and 40*c* for Y, M, and C colors separated from the photosensitive drums 1*a*, 1*b*, and 1*c*, respectively, and keep the development roller 40*d* for the BK color in contact with the photosensitive drum 1*d*. Also in the black-and-white mode, the clutches 92*a*, 92*b*, 93*c*, and 93*d* are kept in the states shown in FIG. 18. That is, in the clutch 92*d*, which corresponds to the developing apparatus 4*d*, which is for BK color, the cam portions 116*a* of the clutch controlling member 116 are not in contact with the cam portions 115*c* of the release ring 115, and therefore, the coupler 113 is kept engaged with the coupler 114 by the pressure generated by the resiliency of the spring 112. Therefore, the rotational force from the motor 103 is transmitted to the developing apparatus 4*d*. In the other clutches, that is, the clutches 92*a*, 92*b*, and 92*c*, however, the cam portions 116*c* of the clutch controlling member 116 are in contact with the cam portions 115*c* of the release ring 115, keeping thereby the coupler 113 separated from the coupler 114 against the resiliency of the spring 112. Therefore, the rotational force from the motor 103 is not transmitted to the development rollers 40*a*, 40*b*, and 40*c*.

Figure 19:
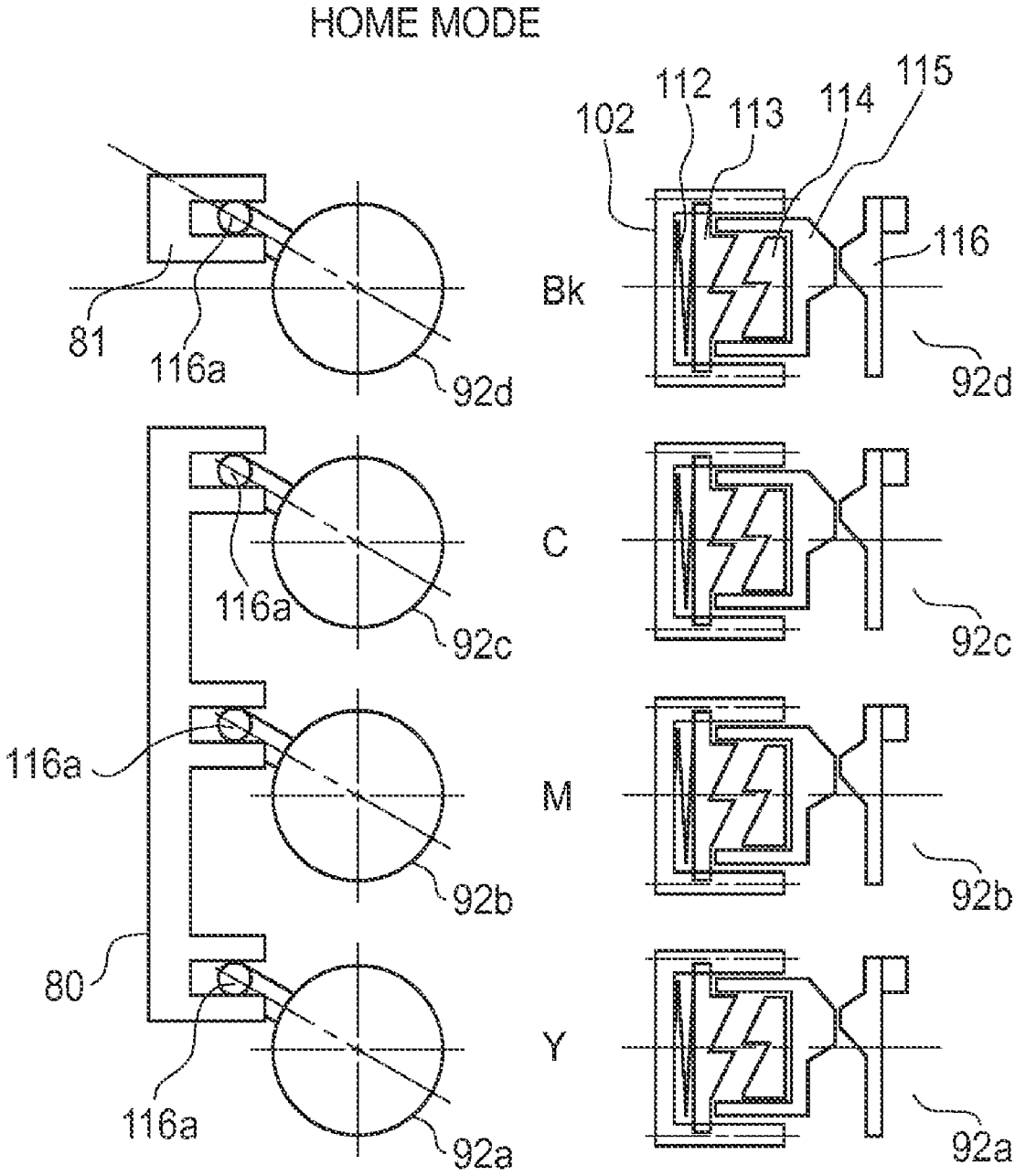
FIG. 19 is a schematic drawing of the development roller separating mechanism in the home mode.

Shown in FIG. 8 is the state of the essential portion of the image forming apparatus, in which the apparatus is in the home mode (on standby). When the apparatus is in this state, the first and second plates 81 and 80 are kept in their top positions by the cams 93 and 94, respectively, to keep the development rollers 40*a*, 40*b*, 40*c*, and 40*d* separated from the photosensitive drums 1*a*, 1*b*, 1*c*, and 1*d*, respectively. When the image forming apparatus is in the home mode, the clutches 92*a*, 92*b*, 92*c*, and 92*d* are kept in the states shown in FIG. 19. That is, in all clutches 92*a*, 92*b*, 92*c*, and 92*d*, the cam portions 116*c* of the clutch controlling member 116 are in contact with the cam portions 115*c* of the release ring 115, keeping thereby the coupler 113 separated from the coupler 114 against the resiliency of the spring 112. Therefore, the rotational force from the motor 103 is transmitted to none of the development rollers 40*a*, 40*b*, 40*c*, and 40*d*.

That is, the development roller separating mechanism moves the first plate 81 and/or second plate 80 to select one of the abovementioned three modes, that is, the full-color mode, black-and-white mode, or home mode.

As will be evident from the description given above, in this embodiment, only a single motor, or the motor 103 (FIG. 10), is used as multiple driving force sources, that is, the driving force source for rotating the photosensitive drums 1, the driving force source for rotating the development rollers 40, and the driving force source for operating the development roller separating mechanism. Therefore, it is possible for the rotation of each photosensitive drum 1 to be independently controlled from those of the others. Therefore, the image forming apparatus in this embodiment is far less likely to suffer from the long standing problems in the field of a full-color image forming apparatus of the inline type, that is, the image deviation in terms of position and/or color, than an image forming apparatus in accordance with the prior art. Obviously, the cost of providing an image forming apparatus with the clutches 92 is much smaller than the cost of providing an image forming apparatus with motors dedicated to the driving of the development rollers 40 in addition to the motor dedicated to the driving of the photosensitive drums 1.

(Operation for Mounting Process Cartridge)

Next, the operation for mounting the process cartridge(s) 7 into the printer main assembly 100 will be described.

Figure 4:
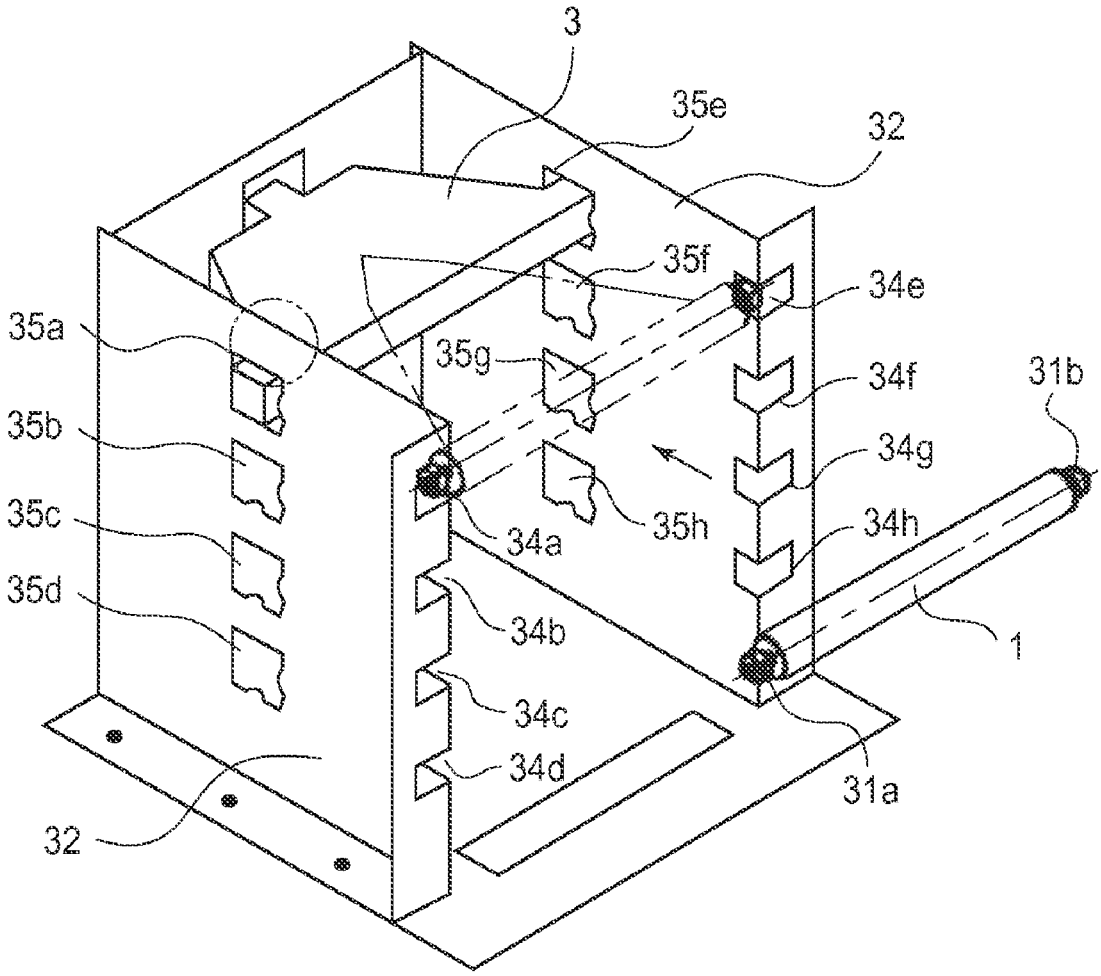
FIG. 4 is a perspective view of the main frame of the image forming apparatus and one of the process cartridges, in the first embodiment, showing how the process cartridge is mounted into the apparatus main assembly.

Referring to FIG. 4, the cartridge 7 is to be inserted into the printer main assembly 100 from the direction indicated by an arrow mark in the drawing, so that it will be precisely placed in the preset position in the printer main assembly 100. Incidentally, in order to prevent the description of this cartridge mounting operation from becoming excessively complicated, only single photosensitive drum 1, that is, the photosensitive drum 1*a* and a single bearing 31, that is, the bearing 31*a*, are shown in FIG. 4.

Referring to FIG. 2, while the cartridge 7 is outside the apparatus main assembly, and is left alone, the development roller 40*a* in the cartridge 7*a* remains in contact with the photosensitive drum 1*a* in the cartridge 7*a*. The cartridge 7*a* is to be inserted into the apparatus main assembly in the direction by the arrow mark in FIG. 4, with the photosensitive drum bearings 31 being guided by a pair of first guiding grooves 34*a* (34*b*, 34*c*, or 34*d*). Referring to FIG. 5(*b*), as the bearings 31*a* come into contact with the bearing catching surfaces 37*a* and 38*a* of the guiding groove 34*a*, and are pressed against the surfaces 37*a* and 38*a*, the cartridge 7*a* is accurately positioned relative to the printer main assembly 100. Incidentally, the other cartridges 7*b*, 7*c*, and 7*d* are also accurately positioned relatively to the printer main assembly 100 in the same manner as the cartridge 7*a*.

The structural arrangement for keeping the cartridge 7*a* pressured in the printer main assembly 100 is as follows. That is, referring to FIG. 5(*a*), the printer main assembly 100 is provided with a pair of shafts 39*a*, which are attached to the left and right panels 32 of the printer main assembly 100, one for one, by crimping, and a pair of return springs (coil springs) 30*a*, which are fitted around the pair of shafts 39*a*, one for one. The return coil spring 30*a* is held to the corresponding panel 32 by fitting one end 30*a*1 of the return coil spring 30*a* in the return coil spring anchoring hole 23*a*1 of the panel 32. Before the cartridge 7*a* is mounted into the printer main assembly 100, the return coil spring 30*a* is prevented from rotating, by a stopper 32*b* formed by cutting and bending a part of the side panel 32. However, during the insertion of the cartridge 7*a* into the printer main assembly 100, the return coil spring 30*a* is rotationally wound in the counterclockwise direction against its own resiliency, until it slides over the bearing 31*a* which supports the photosensitive drum 1*a*. After the return coil spring 30*a* slides over the bearing 31*a*, it presses the bearing 31*a* in the direction indicated by an arrow mark F shown in FIG. 5(*a*). The other cartridges 7*b*, 7*c*, and 7*d* are also kept pressed in the same manner.

Referring to FIG. 10, when the cartridge 7*a* is mounted into the printer main assembly 100, the coupler 1*a*1, with which one of the lengthwise ends of the photosensitive drum 1*a* is provided, engages with the coupler 107 on the printer main assembly 100 side. To the coupler 107 the rotational force of the motor 103 is transmitted through gears 101, 105, and 106. The printer main assembly 100 is structured so that the gear 106 and coupler 107 are movable in the direction of the axial line of the gear 106, that is, the directions indicated by arrow marks J1 and J2. More specifically, during the insertion of the cartridge 7*a* into the printer main assembly 100, the gear 106 and coupler 107 remain in their home positions, into which they had been retracted in the direction J1. However, as the door 100*a* (FIG. 1) of the printer main assembly 100 is moved from its open position to closed position after the insertion of the cartridge 7*a* into the printer main assembly 100, the gear 106 and coupling 107 are moved in the direction J2. As a result, the coupler 107, or the coupler on the main assembly side, engages with the coupler 1*a*1.

(Printing Operation of Image Forming Apparatus)

When the image forming apparatus is in the home mode shown in FIG. 8, the first and second plates 81 and 80 of the printer main assembly 100 are in their top positions to which they were pushed up, and therefore, each development roller 40 remains separated from the corresponding photosensitive drum 1. That is, when the image forming apparatus is in the state shown in FIG. 8, the power supply to the apparatus is off, or the developing process is not carried out. It is when the image forming apparatus is in this state that the cartridges 7*a*, 7*b*, 7*c*, and 7*d* are to be mounted into the printer main assembly 100 one by one. Also when the image forming apparatus is in the abovementioned state, the ribs 46*a*, 46*b*, 46*c*, and 46*d* of the developing apparatuses 4*a*, 4*b*, 4*c*, and 4*d* are borne by the first engaging portions 80*a*1, 80*b*1, 80*c*1, and 81*d*1, respectively.

The cartridge 7 is mounted into the printer main assembly 100 as described above. Sometimes, the cartridges are left in the printer main assembly 100, without being used, for a substantial length of time. With the employment of the above described structural arrangement, however, each development roller 40 is kept separated from the photosensitive drum 1 while it is not involved in the ongoing the image forming operation. Therefore, the image forming apparatus in this embodiment does not suffer from the problem that the surface layer of the development roller 40 is permanently deformed by the unnecessary contact between the development roller 40 and photosensitive drum 1.

(Mode Switching Sequence 1)

FIG. 13 is a table showing the mode switching sequence 1. Each time the lever 130*a* is pulled by activation of the solenoid 130 when the image forming apparatus is in the home mode, the cams 93 and 94 are changed in phase angle by 90°. Thus, the first and second plate 81 and 80 are moved upward or downward, because of the profiles of the cams 93 and 94. Therefore, the clutches 92 are engaged or disengaged according to the positions into which the first and second plate 81 and 80 are moved up or down by the rotation of the cams 93 and 94.

In mode switching sequence 1, the operational mode is switched in the order of (1) home mode—(2) black-and-white mode—(3) home mode—(4) full-color mode. As the lever 130*a* is pulled one more time by the activation of the solenoid 130 (which hereafter may be referred to as pulling operation) when the image forming apparatus is in the full-color mode (4), the cams 93 and 94 finish rotating 360° relative to the home position in which they were before they began to be rotated; in other words, they return to their home positions [home mode (1)].

As a printing operation is started by a print signal when the image forming apparatus is in the black-and-white mode, the motor 103 for driving the cartridges 7, and the motor (unshown) for driving the transfer belt 11, begin to rotate. However, the clutches 92 have been disengaged. Therefore, the development rollers 40*a*, 40*b*, 40*c*, and 40*d* do not rotate. Then, the solenoid 130 is activated once. As the solenoid 130 is activated to pull the lever 130*a*, the cams 93 and 94 rotate by 90°. As the cams 93 and 94 rotate 90°, the first plate 81 moves downward, allowing the clutch 92*d*, or the clutch corresponding to the BK color, to engage. Therefore, only the development roller 40*d*, or the development roller for the BK color, is rotated. That is, the force which the first plate 81 has been applying upward is removed. Therefore, the development roller 40*a* is allowed to come into contact with the photosensitive drum 1*a*, making it possible for the image forming apparatus to print a black-and-white image; the image forming apparatus is placed in the black-and-white mode (2).

As the solenoid 130 is activated once more to pull lever 130*a* when the image forming apparatus is in the black-and-white mode, the cams rotate 90°, causing the first plate 81 to move upward. As a result, the development roller 40*d*, or the development roller for the BK color, is separated from the photosensitive drum 1*d*. Then, the rotation of the development roller 40 is stopped, and the cartridge driving motor 103, and the driving of the transfer belt 11, are stopped; in other words, the image forming apparatus is placed in the home mode (3).

In the case of the full-color mode, as the solenoid 130 is activated once to pull the lever 130*a* when the image forming apparatus is in the home mode (3), the cams 93 and 94 rotate 90°. As the cams 93 and 94 rotate 90°, the first and second plates 81 and 80 moves downward, allowing the clutches 92*a*, 92*b*, and 92*c*, or the clutches for Y, M, and C colors, and the clutch 92*d*, or the clutch for the BK color, to engage. Therefore, the development rollers 40*a*, 40*b*, 40*c*, and 40*d* are rotated. That is, the force which has been applied upward by the first plate 81, is removed. Therefore, the development rollers 40*a*, 40*b*, 40*c*, and 40*d*, or the development rollers for all colors, are allowed to come into contact with the photosensitive drums 1*a*, 1*b*, 1*c*, and 1*d*, making it possible for the image forming apparatus to print in full color; the image forming apparatus is placed in the full-color mode (4).

As the solenoid 130 is activated once to pull the lever 130*a* when the image forming apparatus is in the full-color mode, the cams 93 and 94 rotate 90°, causing the first and second plates 81 and 80 to move upward. As a result, all development rollers 40, or the development rollers for all colors, are separated from the corresponding photosensitive drums 1. Then, the rotation of the development roller 40 is stopped, and the driving of the cartridge driving motor 103 and the driving of the transfer belt 11, are stopped; in other words, the image forming apparatus is placed in the home mode (1).

The image forming process carried out by an image forming apparatus such as the above described one includes the so-called pre-rotation step, which is carried out before the formation of an electrostatic latent image by the scanner unit 3, to ensure that the peripheral surface of a photosensitive drum is uniformly charged, the so-called post-rotation step, which is carried out after the development of the electrostatic latent image into a toner image, to clear the peripheral surface of the photosensitive drum 1 of potential, etc.

During these steps, the photosensitive drums 1 are rotated. As described above, in this embodiment, the image forming apparatus is structured so that the separation of the development roller is ended with the same timing as the timing with which the development operation is started. Therefore, during the pre-rotation step and post-rotation step, the development roller 40 remains separated from the corresponding photosensitive drum 1. Therefore, the image forming apparatus in this embodiment is substantially smaller, in the amount by which the surface layer of the photosensitive drum 1 is shaved by the friction between the peripheral surfaces of the photosensitive drum 1 and development roller 40 during the pre-rotation and post-rotation steps, as well as the step in which the photosensitive drum 1 is rotated for actual image formation, than an image forming apparatus in accordance with the prior art.

In the mode switching sequence 1, there are two home modes: home mode (1) and home mode (3). In this case, either home mode (1) or (3) may be designated as the normal home mode. For example, if the home mode (1) is selected as the normal home mode, all that is necessary to switch to the black-and-white mode is to activate the solenoid once to pull the lever. However, in order to switch to the full-color mode, the solenoid must be activated three times to pull the lever three times, requiring more time.

On the other hand, if the home mode (3) is selected as the normal home mode, all that is necessary to switch to the full-color mode is to activate the solenoid once to pull the lever once. However, in order to switch to the black-and-white mode, the solenoid must be activated three times to pull the lever three times, requiring more time.

Therefore, which of the two home modes, that is, the home mode (1) or home mode (3), should be selected as the normal home mode may be determined according to the frequency at which the image forming apparatus is used in the black-and-white or full-color mode by a user. That is, a user is allowed to set the home mode to minimize the length of time necessary to switch the operational mode. For example, a user who more frequently uses the image forming apparatus in the full-color mode than the black-and-white mode may select the home mode (3) as the normal home mode.

(Mode Switching Sequence 2)

Mode switching sequence 2 is different from mode switching sequence 1 in the shape of the cams 93 and 94 and the order in which the image forming apparatus is switched in operational mode. Referring to FIG. 14, in this mode switching sequence, the mode is switched in the sequence of (1) home mode—(2) black-and-white mode—(3) full-color mode—(4) black-and-white mode.

In this mode switching sequence, in order to separate the development roller, which is in contact with the photosensitive drum 1, from the photosensitive drum 1, it is necessary to rotate the development unit by applying upward pressure to the rib of the development unit against a pressure application spring 54. Therefore, the power source for the mode switching is subjected to a heavy load when separating the development roller 40 from the photosensitive drum 1.

First, this mode switching sequence 2 is compared to mode switching sequence 1 in terms of the process of separating the development roller 40, which is in contact with the photosensitive drum 1, from the photosensitive drum 1, and the number of cartridges which are operated at the same time.

In mode switching sequence 1, when switching from (3) home mode to (4) full-color mode, the separation of the development roller 40, which is in contact with the photosensitive drum 1, from the photosensitive drum 1 occurs in all cartridges, that is, the cartridge for black toner, and all cartridges for the color toners, whereas in mode switching sequence 2, when switching from (3) full-color mode to (4) black-and-white mode, a total of three development rollers 40, that is, the development rollers in the cartridges for the three colors, are separated from the corresponding photosensitive drums 1.

Thus, the amount of load which must be borne by the motor 103, as the mode switching power source, in mode switching sequence 2 is roughly 75% of that in mode switching sequence 1; mode switching sequence 2 is smaller in the amount of load which must be borne by the motor 103. Therefore, mode switching sequence 2 makes it possible to reduce in size the motor as the mode switching power source.

(Mode Switching Sequence 3)

Not only is this mode switching sequence 3 different from the mode switching sequence in the first embodiment in the shapes of the cams 93 and 94 and the mode switching order, but also, in that in this sequence, the speed reduction ratios between the gear 132 and cam gear 133 is set to 3. That is, each time the solenoid 130 is activated, the cam gear 133 is rotated 120°. Referring to FIG. 15(*a*), the operational mode is switched in the order of (1) home mode—(2) black-and-white mode—(3) full-color mode.

Mode switching sequence 3 is smaller in the number of mode switching steps than mode switching sequences 1 and 2, and therefore, is shorter in the total length of time necessary to switch to the full-color mode or black-and-white mode, and then, back to the home mode; it can minimize the total length of time necessary for the mode switching. Referring to FIG. 15(*b*), the operational mode may be switched in the order of (1) home mode—(2) full-color mode—(3) black-and-white mode.

(Another Development Roller Separating Mechanism)

Figure 20:
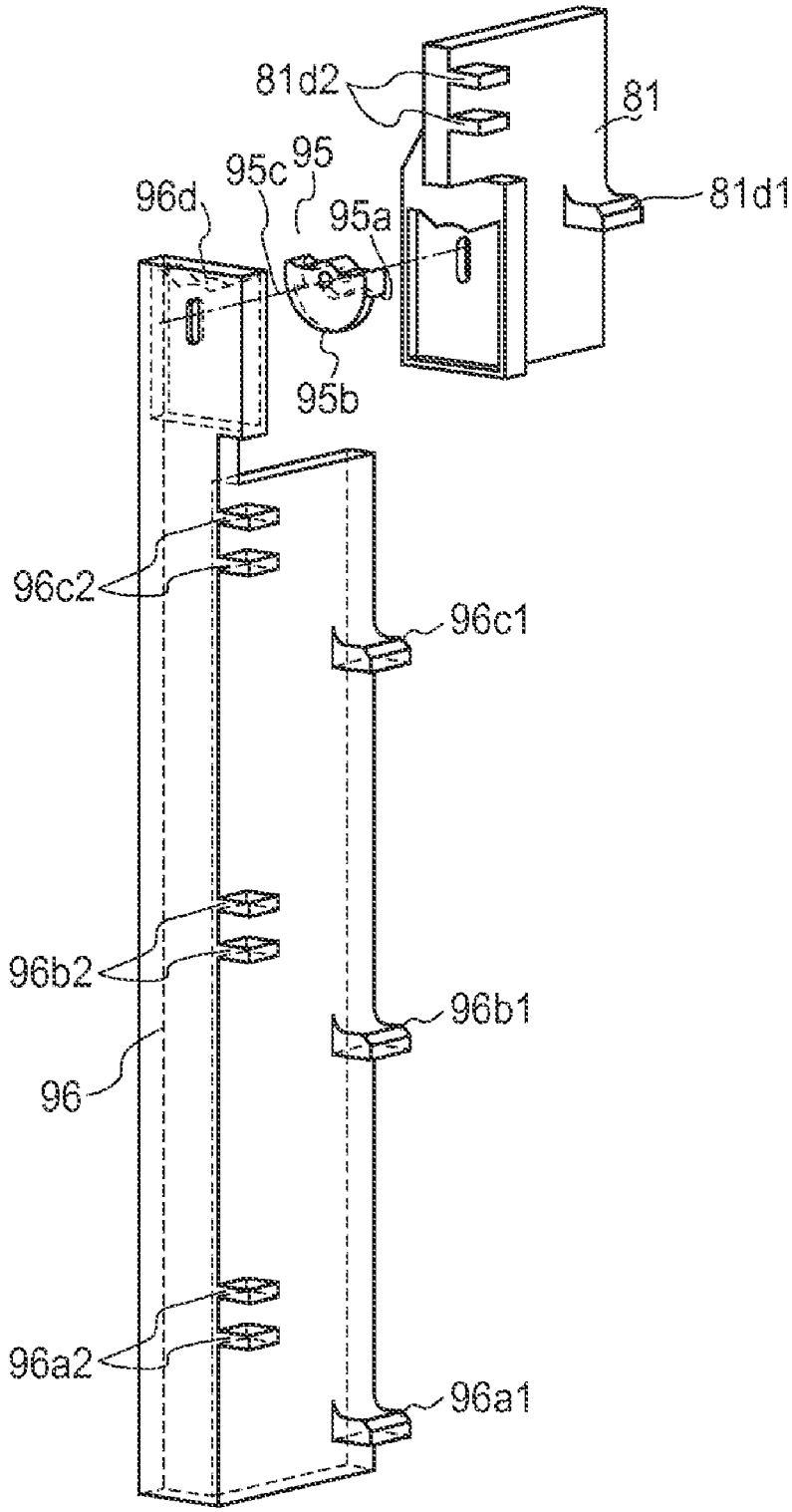
FIG. 20 is a perspective view of the modified versions of the development roller separating plates and development roller separating cam in the first embodiment.

In the first embodiment described above, the cam 94 as the first cam, and the cam 93 as the second cam, are two different components as shown in FIG. 9. However, the two cams 93 and 94 may be two different portions of the same component, as shown in FIG. 20. That is, a cam 95 has a cam portion 95*a*, which is equivalent to the cam 94 as the first cam, and a cam portion 95*b*, which is equivalent to the cam 93 as the second cam. The cam 95 is solidly attached to a shaft 95*c*, which is rotated by the rotational force from the motor 103. The first plate 81, in this mechanism, on which the cam portion 95*a* acts, is the same in structure as the first plat 81 in the first embodiment, which is shown in FIG. 9. However, the second plate 96 in this embodiment is different from the second plate 80 shown in FIG. 9, in that the engaging portion 96*d* of the second plate 96, on which the cam portion 95*b* acts, is on the opposite side of the second plate from the engaging portion of the second plate 80, shown in FIG. 9, in terms of the direction of the axial line of the shaft 95*c* of the cam 95. Further, the first engaging portions 96*a*1, 96*b*1, and 96*c*1, which are in the form of a protrusion, and the second engaging portions 96*a*2, 96*b*2, and 96*c*2, which are in the form of a pair of protrusions, protrude from the surface of the second plate 96. They are the same in function as the counterparts of the first plate 80 shown in FIG. 9.

Further, the structural arrangements in the second embodiment other than the above described one are the same as those in the first embodiment, and the effects obtainable by this embodiment are the same as those obtainable by the first embodiment.

[Embodiment 3]

Figure 21:
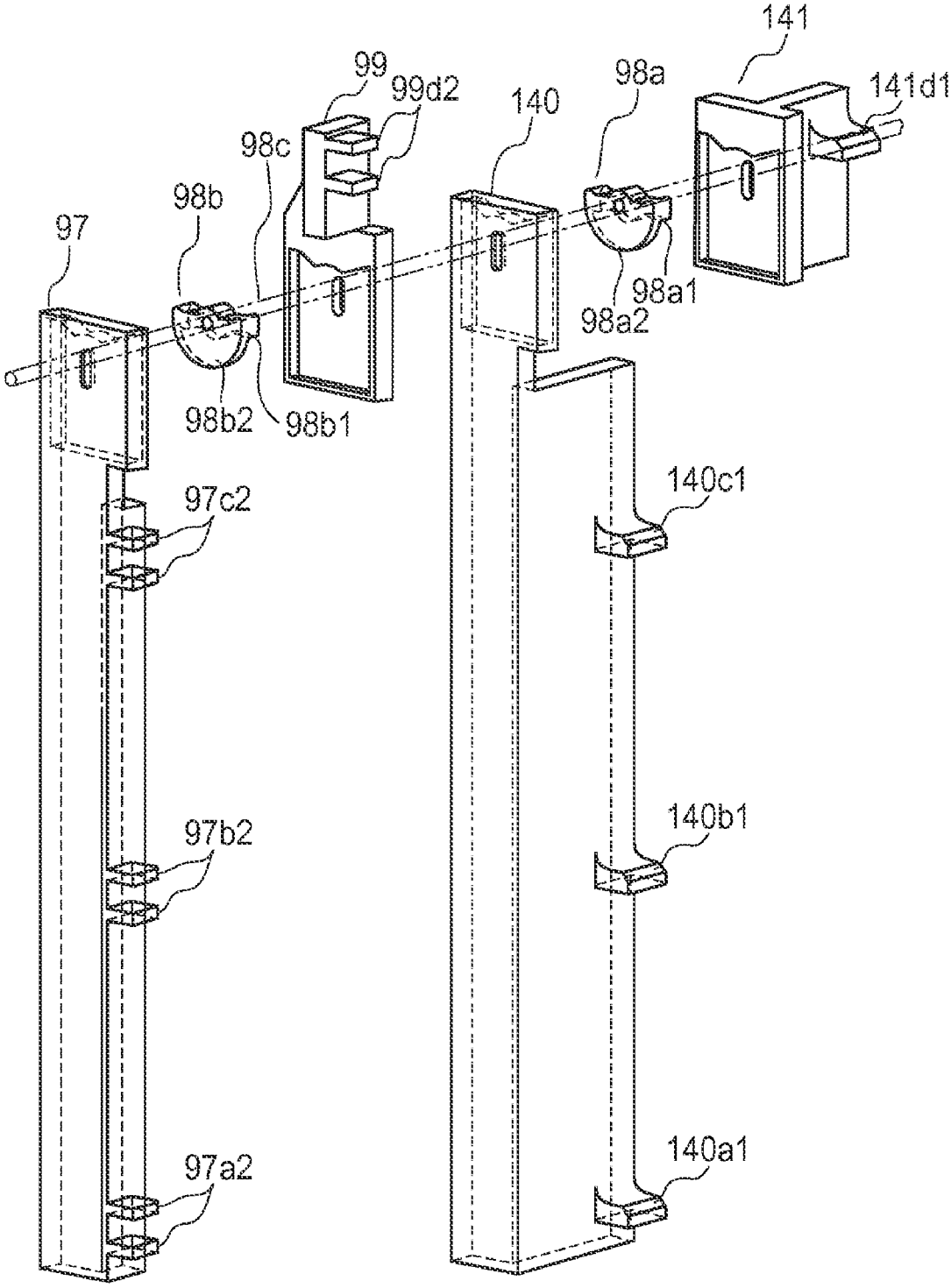
FIG. 21 is a perspective view of the development roller separating plates and development roller separating cams in the third embodiment.

In the first and second embodiments, the protrusions which act on the clutches, one for one, and the protrusions which act on the developing apparatuses, one for one, protrude from the surface of the same plate. However, an image forming apparatus may be structured so that the plate from which the protrusions which act on the clutches, one for one, protrude, may be different from the plate from which the protrusions which act on the developing apparatuses, one for one, protrude, as shown in FIG. 21. That is, a first plate 99, as the first member, has an engaging portion 99*d*2, which acts on the first clutch 92*d*. A second plate 97, as the second member, has engaging portions 97*a*2, 97*b*2, and 97*c*2, which act on the second clutches 92*a*, 92*b*, and 92*c*. It is a cam 98*b*, as the first mode switching member, that acts on the first and second plates 99 and 97. The cam 98*b* is solidly attached to a shaft 98*c*, which rotates by receiving the driving force from the motor 103. The cam 98*b* has a first portion 98*b*1, which comes into contact with the first plate 99 and moves it, and a second portion 98*b*2 which comes into contact with the second plate 97 and moves it. The shape of the cam 98*b* is the same as that in the second embodiment, and the movements of the first and second plates 99 and 97, which are caused by the cam 98*b*, are the same as those in the first and second embodiments.

The printer main assembly 100 has a third plate 141 as the third member, and a fourth plate 140 as the fourth member. The third plate 141 acts on only the rib 46*d* with which the developing apparatus 4*d*, which contains the toner of black color, is provided. The fourth plate 140 acts on the ribs 46*a*, 46*b*, and 46*c*, that is, the ribs with which the developing apparatuses 4*a*, 4*b*, and 4*c*, that is, the developing apparatuses which contain the toners of the colors (Y, M, and C) other than black, are provided, respectively. The fourth plate 140 is provided with engaging portions 140*a*1, 140*b*1, and 140*c*1, which are in the form of a protrusion and protrude from the surface of the fourth plate 140. The engaging portions 140*a*1, 140*b*1, and 140*c*1 move the developing apparatuses 4*a*, 4*b*, and 4*c* by coming into contact with the ribs 46*a*, 46*b*, and 46*c*, respectively. The third plate 141 is provided with engaging portion 141*d*1, which is in the form of a protrusion and protrudes from the surface of the third plate 141. The engaging portion 141*d*1 moves the developing apparatus 4*d* by coming into contact with the rib 46*d*. It is cam 98*a*, as the second mode switching member, that acts on the third and fourth plates 141 and 140. The cam 98*a* is solidly attached to a shaft 98*c* which rotates by receiving the driving force from the motor 103. Further, the cam 98*a* is provided with a third portion portion 98*a*1, which moves the third plate 141 by coming in contact with the third plate 141, and a fourth portion 98*a*2, which moves the fourth plate 140 by coming into contact with the fourth plate 140. The shape of the cam 98*a* is the same as that in the second embodiment, and the movements of the third and fourth plates 141 and 140, which are caused by the cam 98*a*, are the same as those in the first and second embodiments. With the employment of the above described structural arrangement, the same home mode, black-and-white mode, and full-color mode as those in the first embodiment can be carried out. Further, the structural arrangements in the third embodiment other than the above described one are the same as those in the first embodiment, and the effects obtainable by this embodiment are the same as those obtainable by the first embodiment.

In the first to third embodiments described above, the image forming apparatuses were structured so that the cartridges 7*a*, 7*b*, 7*c*, and 7*d* were removably juxtaposed in vertical straight line in the printer main assembly 100. However, these embodiments are not intended to limit the present invention in scope. That is, the present invention is also applicable to an image forming apparatus (printer) structured so that the cartridges 7*a*, 7*b*, 7*c*, and 7*d* are removably juxtaposed in virtually horizontal straight line in the apparatus main assembly (printer main assembly 100). In such a case, the apparatus main assembly is structured so that the first plate as the first member, and the second plate as the second member, are horizontally moved. Further, the present invention is also applicable to an image forming apparatus (printer) structured so that the cartridges 7*a*, 7*b*, 7*c*, and 7*d* are removably juxtaposed in the slanted straight line (relative to horizontal direction) in the apparatus main assembly (printer main assembly 100). In such a case, the apparatus main assembly is structured so that the first plate as the first member, and the second plate as the second member, are moved in the slanted direction (relative to horizontal direction).

Also in the first to third embodiments described above, in order to transmit to each of the cartridges 7*a*, 7*b*, 7*c*, and 7*d* a driving force that is independently from the driving force transmitted to the rest, the image forming apparatuses were provided with multiple motors 103, that is, one for each cartridge. However, an image forming apparatus may be structured so that the rotational force from a single motor is transmitted to each of the cartridge 7*a*, 7*b*, 7*c*, and 7*d*.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 004104/2006 and 346204/2006 filed Jan. 11, 2006 and Dec. 22, 2006, respectively, which are hereby incorporated by reference.

What is claimed is:

1. An image forming apparatus for forming a color image on a recording material comprising:

(i) a plurality of process cartridges, each of which includes a photosensitive drum and a developing roller that develops an electrostatic latent image formed on the photosensitive drum, the process cartridges including a black process cartridge containing a black developer and a non-black process cartridge containing a non-black developer;

(ii) a driving source;

(iii) a first clutch that connects and disconnects said driving source and the developing roller of the black process cartridge, and that selects driving force transmission to the developing roller of the black process cartridge;

(iv) a second clutch that connects and disconnects said driving source and the developing roller of the non-black process cartridge, and that selects driving force transmission to the developing roller of the non-black process cartridge;

(v) a movable first member, actable on said first clutch, that switches between an operation state for transmitting a driving force from said driving source to the developing roller of the black process cartridge and a non-operation state of not transmitting the driving force thereto;

(vi) a movable second member, actable on said second clutch, that switches between an operation state for transmitting the driving force to the developing roller of the non-black process cartridge and a non-operation state of not transmitting the driving force thereto; and (vii) a switching member, actable on said first member and said second member, that switches among (a) the operating states of said first clutch and said second clutch, (b) the non-operating states of said first clutch and said second clutch, and (c) the operating state of said first clutch and the non-operating state of said second clutch, wherein said switching member includes a first portion that contacts said first member to move said first member, said first portion being rotatable, and a second portion that contacts said second member to move said second member, said second portion being rotatable, and wherein said first portion and said second portion are rotatable only in a predetermined direction.

2. An apparatus according to claim 1, wherein said first portion and said second portion are integral with each other.

3. An apparatus according to claim 1, wherein said switching member is rotatable, and is capable of stopping at intervals of a predetermined angle within one full rotation thereof, and wherein the predetermined angle is 90 degrees.

4. An apparatus according to claim 1, wherein said switching member is rotatable, and is capable of stopping at intervals of a predetermined angle within one full rotation thereof, and wherein the predetermined angle is 120 degrees.

5. An apparatus according to claim 1, wherein said driving source includes one motor capable of transmitting the driving force to the plurality of process cartridges.

6. An apparatus according to claim 1, wherein said driving source includes motors for supplying the driving force to the process cartridges.

7. An image forming apparatus for forming a color image on a recording material, comprising:

(i) a plurality of process cartridges, each of which includes a photosensitive drum, a developing roller that develops an electrostatic latent image formed on the photosensitive drum, a first frame that rotatably supports the photosensitive drum, and a second frame that rotatably supports the developing roller, the second frame being movable relative to the first frame to contact the developing roller to the photosensitive drum and to space the developing roller from the photosensitive drum, the process cartridges including a black process cartridge containing a black developer and a non-black process cartridge containing a non-black developer;

(ii) a driving source;

(iii) a first member that acts on the second frame of the black process cartridge and that switches between an operation state to contact the photosensitive drum and the developing roller to each other, and a non-operation state in which the photosensitive drum and the developing roller are spaced from each other;

(iv) a second member that acts on the second frame of the non-black process cartridge and that switches between an operation state to contact the photosensitive drum and the developing roller to each other, and a non-operation state in which the photosensitive drum and the developing roller are spaced from each other; and (v) a switching member, actable on said first member and said second member, that switches among (a) the operating states of said second frame of the black process cartridge and said second frame of the non-black process cartridge, (b) the non-operating states of said second frame of the black process cartridge and said second frame of the non-black process cartridge, and (c) the operating state of said second frame of the black process cartridge and the non-operating state of said second frame of the non-black process cartridge, wherein said switching member includes a first portion that contacts said first member to move said first member, said first portion being rotatable, and a second portion that contacts said second member to move said second member, said second portion being rotatable, and wherein said first portion and said second portion are rotatable only in a predetermined direction.

8. An apparatus according to claim 7, wherein said first portion and said second portion are integral with each other.

9. An apparatus according to claim 7, wherein said switching member is rotatable, and is capable of stopping at intervals of a predetermined angle within one full rotation thereof, and wherein the predetermined angle is 90 degrees.

10. An apparatus according to claim 7, wherein said switching member is rotatable, and is capable of stopping at intervals of a predetermined angle within one full rotation thereof, and wherein the predetermined angle is 120 degrees.

* * * * *